US007129404B2

(12) United States Patent
Inoue

(10) Patent No.: US 7,129,404 B2
(45) Date of Patent: Oct. 31, 2006

(54) KEYBOARD MUSICAL INSTRUMENT HAVING KEYS REGULATED WITH STABLE KEY BALANCE PIECES AND PROCESS FOR FABRICATING KEYS

(75) Inventor: Satoshi Inoue, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 52 days.

(21) Appl. No.: 10/734,376

(22) Filed: Dec. 11, 2003

(65) Prior Publication Data

US 2004/0123728 A1 Jul. 1, 2004

Related U.S. Application Data

(63) Continuation-in-part of application No. 10/289,898, filed on Nov. 7, 2002, now Pat. No. 7,067,730.

(30) Foreign Application Priority Data

Nov. 8, 2001 (JP) ..... 2001-342943
Nov. 29, 2001 (JP) ..... 2001-363799
Mar. 15, 2002 (JP) ..... 2002-072627

(51) Int. Cl.
*G10C 3/12* (2006.01)

(52) U.S. Cl. ..... 84/433; 84/439; 84/243

(58) Field of Classification Search ..... 84/423 R, 84/433, 439–440, 236, 243; 16/2.1–2.5, 16/386, 379
See application file for complete search history.

(56) References Cited

U.S. PATENT DOCUMENTS 1,972,119 A 9/1934 Wernhardt
2,183,243 A 12/1939 Meersteiner
2,393,923 A 1/1946 Edwin
3,736,834 A * 6/1973 MacDonald ..... 411/351
3,921,496 A 11/1975 Helderman
4,046,181 A * 9/1977 Barnsdale ..... 411/180
4,512,234 A * 4/1985 Kumano ..... 84/433
4,679,477 A 7/1987 Monte
4,899,631 A 2/1990 Baker
5,158,003 A * 10/1992 Lee ..... 84/439
5,395,194 A * 3/1995 Johnson et al. ..... 411/353
5,574,241 A * 11/1996 Kumano et al. ..... 84/439
5,585,582 A * 12/1996 Stanwood ..... 84/432
5,716,289 A * 2/1998 Okoneski ..... 473/297
5,796,024 A * 8/1998 Stanwood ..... 84/433
6,191,351 B1 * 2/2001 Niitsuma ..... 84/720
6,193,456 B1 * 2/2001 Stumpf et al. ..... 411/180
6,290,702 B1 9/2001 Fucci et al.
6,531,651 B1 * 3/2003 Kanemitsu et al. ..... 84/433
2001/0027712 A1 * 10/2001 Kanemitsu et al. ..... 84/433

FOREIGN PATENT DOCUMENTS

| | | |
|---|---|---|
| CN | 1407537 | 4/2003 |
| DE | 195 38 267 | 10/1995 |
| JP | UM 32-004101 | 5/1957 |
| JP | 53-23219 | 2/1978 |
| JP | 11-212543 | 8/1999 |

(Continued)

*Primary Examiner*—Lincoln Donovan
*Assistant Examiner*—David S. Warren
(74) *Attorney, Agent, or Firm*—Morrison & Foerster LLP

(57) ABSTRACT

A key is an indispensable component parts of an acoustic or electronic keyboard musical instrument, and key balancers are embedded in the key for varying the moment exerted on the key; the key balancers are fastened to the key by means of an anchor so that the key balancers are neither chattered in nor dropped out from the key.

3 Claims, 13 Drawing Sheets

FOREIGN PATENT DOCUMENTS

| | | |
|---|---|---|
| JP | 2001-142454 | 5/2001 |
| JP | 2001-147685 | 5/2001 |
| JP | 2001-154661 | 6/2001 |
| JP | 2001-175248 | 6/2001 |
| JP | 2001-195056 | 7/2001 |
| JP | 2003-084754 | 3/2003 |
| JP | 2003-108113 | 4/2003 |

* cited by examiner

KEYBOARD MUSICAL INSTRUMENT HAVING KEYS REGULATED WITH STABLE KEY BALANCE PIECES AND PROCESS FOR FABRICATING KEYS

CROSS-REFERENCE TO RELATED APPLICATION

This application is a continuation-in-part of U.S. application Ser. No. 10/289,898 filed on Nov. 7, 2002, now U.S. Pat. No. 7,067,730, which application is specifically incorporated herein, in its entirety, by reference.

BACKGROUND OF THE INVENTION

1. Field of the Invention

This invention relates to a keyboard musical instrument and, more particularly, to a keyboard musical instrument having keys regulated with key balance pieces.

2. Description of the Related Art

The keyboard musical instruments are categorized in three groups. The first group is an electric or electronic keyboard musical instrument, and the second group is an acoustic keyboard musical instrument. Acoustic pianos, i.e., grand pianos and upright pianos are typical examples of the acoustic keyboard musical instrument. The third group is a compromise between the electric/electronic keyboard musical instrument and the acoustic keyboard musical instrument. A silent piano is an example of the composite keyboard musical instrument between an acoustic piano and an electronic keyboard. The user has an option between acoustic piano tones and electronic tones. This means that the user can perform a passage through the acoustic piano tones or electronic tones.

In any sort of keyboard musical instrument, keys are indispensable component parts of the keyboard musical instrument, and serves as an interface between the keyboard musical instrument and users. The users specify the pitches of the tones to be produced through the keys. The acoustic keyboard musical instruments such as pianos give unique key-touch to the players, and the key-touch on the electronic keyboards is different from that of the acoustic keyboard musical instrument. Since the players are familiar with the key-touch on their keyboard musical instruments, the players, who usually play on the acoustic pianos, feel the keys of the electronic keyboards unfamiliar, and the players, who finger pieces of music on the electronic keyboard, feel the keys of the acoustic pianos strange. Professional pianists discriminate the key-touch of their own pianos from the key-touch of other pianos.

One of the factors of the key-touch is the appropriate difference between moment of force and the counter moment of force exerted on the respective keys. Another factor of the key-touch is the largeness of inertial of the respective keys. The keys are put on the balance rail so that the balance rail gives the fulcrums to the keys. Each key supports the action unit at the rear portion thereof, and exerts moment on the key. On the other hand, key balance pieces are, by way of example, embedded in the front portions of the keys in grand pianos, and exert the counter moment on the key. The key balance pieces are usually embedded in the rear portions of the keys in upright pianos. The moment is larger than the counter moment at the rest position so that the front portion floats over the key bed. When a pianist depresses the front portion, the front portion is sunk. The heavier the key balance pieces, the lighter the static key-touch. On the contrary, the heavier the key balance pieces, the heavier the dynamic key-touch. Thus, both of the differences between the moment and the counter moment and the largeness of moment of inertial have the influence on the key-touch.

FIG. 1 shows a typical example of the essential parts of the acoustic piano. In the following description term "front" is indicative of a position closer to a pianist, who sits on a stool for fingering, than a "rear" position. Term "fore-and-aft" direction is indicative of a virtual line between a front position and a corresponding rear position, and term "lateral" modifies the direction perpendicular to the fore-and-aft direction.

A keyboard 1 is mounted on a key bed 2, and a front rail 3*a*, a balance rail 3*b* and a back rail laterally extend on a key frame 4. Black and white keys 5*a* and 5*b* are put in parallel on the balance rail 3*b*, and extend in the fore-and-aft direction. The balance rail 3*b* gives the fulcrums 3*d* to the black and white keys 5*a*/5*b* so that the black and white keys 5*a*/5*b* are rotatable about the balance rail 3*b*. The front portions of the white keys 5*b* are covered with thin decorative plates 5*c* made of synthetic resin.

Capstan buttons 6 project from the rear portions of the black/white keys 5*a*/5*b*, and is held in contact with action units 7. The action units 7 are rotatably connected to a whippen rail 8, which laterally extends over the rear portions of the arrays of black and white keys 5*a*/5*b*. The whippen rail 8 is supported by action brackets 9 on the key frame 4. A shank flange rail 10 is further supported by the action brackets 9, and laterally extends over the array of black and white keys 5*a*/5*b*. Hammers 11 are rotatably connected to the shank flange rail 10. The action units 7 are functionally connected to the hammers 11, and receive the weight of the associated hammers 11. When a pianist depresses a black/white key 5*a*/5*b*, the associated action unit 7 is actuated so as to drive the hammer 11 for rotation. The jack of the action unit 7 escapes from the hammer 11, and the hammer starts the free ration. The hammer 11 strikes an associated string 12 at the end of the free rotation, and returns onto the action unit 7.

The weight of the hammer 11 and action unit 7 is applied through the capstan screw 6 to the rear portion of the associated black/white key 5*a*/5*b*, and, accordingly, the moment is exerted on the black/white key 5*b* in the clockwise direction. In order to partially cancel the moment, counter moment is exerted on the black/white key 5*a*/5*b*, and key balance pieces 5*d* are embedded in the front portion of the black/white key 5*a*/5*b* for the counter moment. The counter moment is smaller than the moment so that the front portion floats over the front rail 3*a*.

The key balance pieces 5*d* have a generally cylindrical shape, and both ends are exposed to the side surfaces of the black/white key 5*a*/5*b*. The key balance pieces 5*d* are of the order of 10 millimeters in diameter. The key balance pieces 5*d* are also embedded in the other black/white keys 5*a*/5*b*. The key balance pieces 5*d* are made of lead. The key balance pieces 5*d* are embedded in the black/white keys 5*a*/5*b* as follows. First, through-holes 5*e* are formed in the front portions of the black and white keys 5*a*/5*b* (see FIG. 2). Cylindrical lead pieces are prepared, and have a diameter less than the diameter of the through-holes 5*e*. The cylindrical lead pieces are smoothly inserted into the through-holes 5*e*. A pair of bits 12 is pressed against the exposed surfaces of each cylindrical lead piece. The cylindrical lead piece is plastically deformed, and both end portions are radially spread. As a result, the deformed end portions 5*f* are tightly fit to the inner surfaces of the black/white key 5*a*/5*b*.

Thus, the key lead pieces 5*d* are anchored to the associated black/white key 5*a*/5*b* by means of the deformed end portions 5*f*.

The first reason why the lead is used is that the lead has the large specific gravity. The specific gravity of the lead is 11.34, and is one of the heaviest industrial metals. This means that small lead pieces give rise to large moment, and small space such as the narrow through-holes 5*e* are merely required for the small lead pieces. The key balance pieces 5*d* of lead can exert large counter moment on the black and white keys 5*a*/5*b*. In other words, a tuner can adjust the black/white key 5*a*/5*b* to the most desirable key-touch between the light key-touch and the heavy key-touch.

Another reason why the lead is used is that the lead is rich in plasticity. As described hereinbefore, the key balance pieces 5*d* are anchored to the associated black/white key 5*a*/5*b* through the plastically deforming process. If the cylindrical balance pieces are made of hard metal, large force is to be exerted on the both end portions, and the deformed end portions are strongly pressed against the inner surfaces. The black/white keys 5*a*/5*b* are made of wood so that the wooden key 5*a*/5*b* are liable to be broken. Moreover, the hard metal pieces are less fit to the inner surfaces of the black/white key 5*a*/5*b*, and tend to be dropped out.

Yet another reason is that the lead is economical. Although gold and platinum are large in specific gravity and rich in plasticity, they are so expensive that the people can not purchase the acoustic piano. The lead is not expensive, and the manufacturer reduces the production cost of the acoustic piano.

Thus, the key balance pieces 5*d* of lead are preferable for the wooden keys 5*a*/5*b*. However, the lead is detrimental to health, and contaminates the environment. Several alternate materials have been proposed.

One of the alternate materials is disclosed in Japan Patent Application laid-open 2001-142454. The key balance pieces disclosed in the Japan Patent Application laid-open are made of a sort of composite material. The composite material contains resilient material and non-lead metal. The resilient material is mixed with the non-lead metal, and the composite material is shaped in the cylindrical configuration. The resilient material enhances the elasticity of the composite material.

The key balance pieces of the composite material are embedded in the key as follows. First, the through-holes are formed in the wooded key, and cylindrical pieces are tightly inserted into the through-holes. The cylindrical pieces are pressed against the inner surfaces of the through-holes by virtue of the elasticity, the key balance pieces are anchored to the wooden key. Namely, the key balance pieces of the composite material are embedded in the wooden key as similar to the above-described prior art keys 5*a*/5*b*.

Thus, the black/white keys 5*a*/5*b* only rely on the elasticity of the composite material. However, the through-holes are not always the adjusted to the target diameters, and the wooded keys tend to be shrunk for a long service time. In case where the through-holes have narrow through-holes, the wooden keys are liable to be cracked. On the other hand, if the through-holes are too wide, the elastic force is insufficient to keep the cylindrical pieces in the through-holes. When a pianist depresses the key, the key balance pieces chatter in the holes. If the looseness is serious, the key balance piece is dripped out. Thus, a problem is encountered in the key balance pieces disclosed in Japan Patent Application laid-open No. 2001-142454 in that the key balance pieces are not tightly fit into the keys.

Another key balance piece is disclosed in Japan Patent Application laid-open No. 2001-147685. The key balance piece disclosed in the Japan Patent Application laid-open is a combination between a tubular member and a rigid column. The tubular member is made of resilient material, and the rigid column is made of composite material. Plural sorts of non-lead material, which are different in specific gravity, are mixed in such a manner that the composite material is adjusted to a target value of the specific gravity. The rigid columns are received in the resilient tubular members, and the resilient tubular members are inserted into the holes formed in the key through a press fitting.

The resilient tubular members are well fit in the holes. However, the rigid columns are merely held in the resilient tubular members by the agency of the resiliency of the resilient tubular members. In case where the rigid columns are finished smaller than the design drawing, the rigid columns are liable to be dropped out from the resilient tubular members.

Yet another key balance pieces are disclosed in Japan Patent Application laid-open No. 2001-154661. The key balance pieces disclosed in the Japan Patent Application laid-open is made of composite material, and small semi-spherical projections are formed on the outer surface of the key balance pieces. The composite material consists of plural sorts of non-lead metal and synthetic resin. The key balance pieces are inserted into the holes formed in the key through a press fitting, and the small projections are caught on the inner surfaces. Although most of the small projections are held in contact with the inner surfaces of the key, the semi-spherical projections have round contact surfaces, and are liable to slide on the inner surfaces of the key. In other words, the semi-spherical projections are hardly caught on the inner surfaces of the key. For this reason, the key balance pieces are liable to be dropped out.

Still another key balance piece is disclosed in Japan Patent Application laid-open No. 2001-175248. The key balance piece disclosed in the Japan Patent Application laid-open is made of composite material. Metal or alloy such as copper, brass iron and tungsten are mixed with fluid material such as thermosetting synthetic resin, thermoplastic synthetic resin, fusible alloy and adhesive compound in organic compound series. The metal or alloy is mixed with the fluid material, and the mixture is poured into cavities formed in a key. The mixture is solidified so that the key balance pieces are embedded in the key. However, it is not easy to fill the cavities with the mixture. If the mixture is too much, the key is contaminated with the residue. On the other hand, if the mixture is short, the key balance pieces are liable to be dropped out after the solidification.

Yet another key balance piece is disclosed in Japan Patent Application laid-open No. 2001-195056. The key balance piece disclosed in the Japan Patent Application laid-open consists of a tubular member and a rigid column. The tubular member is made of heat contracting synthetic resin, and the rigid column is made of non-lead metal. The rigid column is received in the tubular member, and the tubular member is inserted into the holes formed in the key through the press fitting. Although the tubular member are made of the heat contracting synthetic resin, the key balance piece consists of the combination of the tubular member and the rigid column as similar to the key balance piece disclosed in Japan Patent Application laid-open No. 2001-142454. For this reason, the key balance pieces are also unstable, and are liable to be dropped out.

The key balance pieces disclosed in those documents are embedded in the keys through the press fitting or solidification of fluid material. However, the key balance pieces are held in the holes or cavities by the agency of friction. For this reason, the key balance pieces are liable to be dropped out from the keys.

Key balancers are also used for the keys incorporated in the electronic keyboards, and are similar to those for the keys of the acoustic pianos. This means that the key balancers are liable to be dropped out from the keys.

SUMMARY OF THE INVENTION

It is therefore an important object of the present invention to provide a keyboard musical instrument, which has keys regulated with stable balancers.

It is also an important object of the present invention to provide a process for fabricating the keys which is simple and conductive to reduction of the production cost.

In accordance with one aspect of the present invention, there is provided a keyboard musical instrument for generating tones comprising a keyboard including plural keys used for specifying pitches of tones to be produced, applied with moments urging the plural keys to rest positions thereof and having respective bars, each of the plural keys has at least one key balancer for applying a regulative moment to the aforesaid each of the plural keys for varying the moment, at least one key balancer has a weight piece made of non-lead material and embedded in the bar of the aforesaid each of the plural keys and an anchor for fixing the weight piece to the bar of the aforesaid each of the plural keys, and the keyboard musical instrument further comprises a tone generating system connected to the plural keys and generating the tones with the pitches.

In accordance with another aspect of the present invention, there is provided a process for fabricating a key incorporated in a keyboard musical instrument comprising the steps of a) preparing a bar formed with a substantially straight through-hole and a weight piece having at least a substantially straight tube portion roughly equal in diameter to the substantially straight through-hole and a core portion disposed in the substantially straight tube portion, b) inserting the weight piece into the substantially straight through-hole, and c) caulking both end portions of the substantially straight tube portion to the side portions of the bar so that both of the both end portions and the side portions are flared.

BRIEF DESCRIPTION OF THE DRAWINGS

The features and advantages of the keyboard musical instrument will be more clearly understood from the following description taken in conjunction with the accompanying drawings, in which FIG. 12 is a cross sectional view showing the second modification of the key balancer shown in FIG. 10, FIG. 13 is a cross sectional view showing the third modification of the key balancer shown in FIG. 10, FIG. 14 is a cross sectional view showing the fourth modification of the key balancer shown in FIG. 10, FIG. 15 is a cross sectional view showing the sixth modification of the key balancer shown in FIG. 10, FIG. 16 is a cross sectional view showing the seventh modification of the key balancer shown in FIG. 10, FIG. 17 is a cross sectional view showing the eighth modification of the key balancer shown in FIG. 10, FIG. 18 is a perspective view showing a white key incorporated in yet another acoustic piano according to the present invention, FIG. 23 is a cross sectional view showing the structure of a key incorporated in still another acoustic piano according to the present invention, FIG. 24 is a cross sectional view showing an essential step incorporated in a process for fabricating the key.

DESCRIPTION OF THE PREFERRED EMBODIMENTS

First Embodiment

Figure 1:
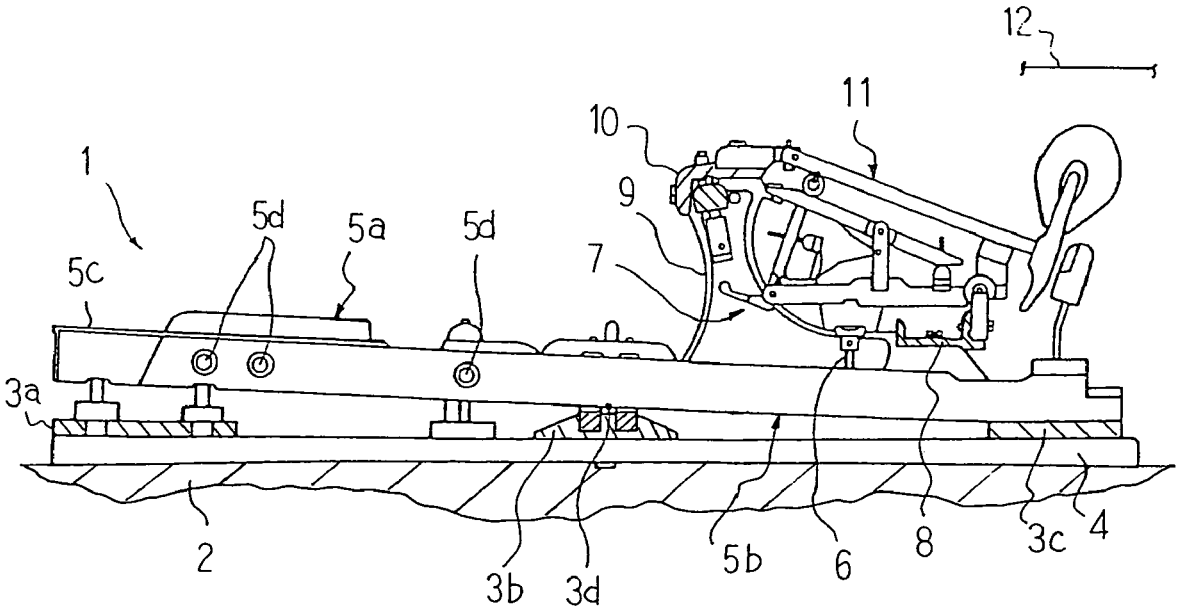
Fig. 1 PRIOR ART
FIG. 1 is a side view showing the essential parts of the prior art acoustic piano.
Figure 2:
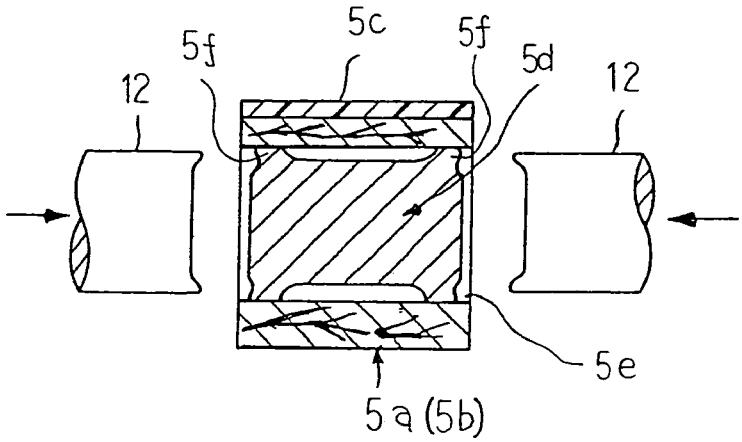
Fig. 2 PRIOR ART
FIG. 2 is a cross sectional view showing the key lead piece embedded in the key.
Figure 3:
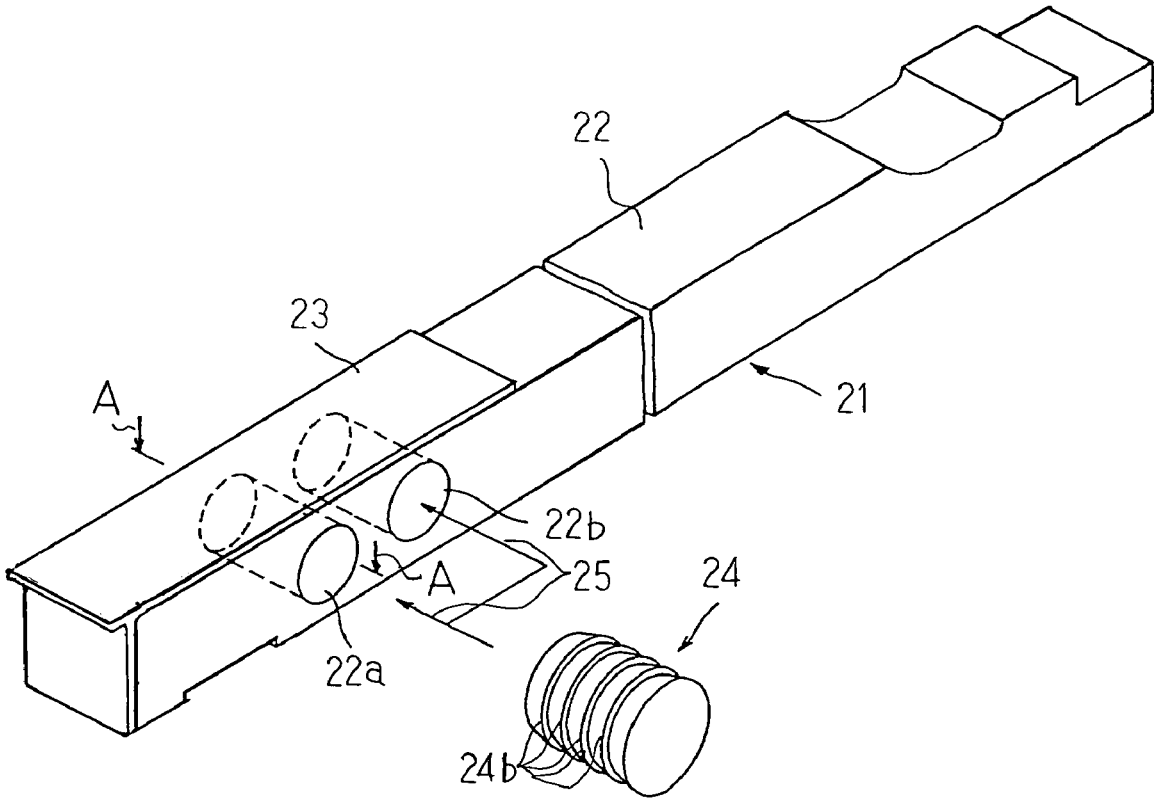
FIG. 3 is a perspective view showing a white key incorporated in an acoustic piano according to the present invention.

FIG. 3 illustrates a key 21 forming a part of a keyboard, which in turn is incorporated in an acoustic piano. The acoustic piano is similar to that shown in FIG. 1 except the keys 21. For this reason, description is focused on the key 21, and the other component parts are specified by using references designating corresponding parts in FIG. 1.

The key 21 serves as a white key, and comprises a wood bar 22, a decorative plate 23 and key balancers 24. The wood bar 22 is made of Japanese spruce, which belongs to silver fir. Although a front portion and a rear portion are shown in FIG. 3, a vertical hole (not shown) is formed in a middle portion of the wood bar 22, and a balance pin (not shown) passes through the vertical hole. The balance pin gives the fulcrum 3*d* to the white key 21 placed on the balance rail 3*b*.

The upper surface and front end surface of the front portion of the white key 21 are covered with the decorative plate 23. The decorative plate 23 is like an angle, and is adhered to the wood bar 22. The decorative plate 23 is made of synthetic resin, and the synthetic resin is colored in white.

Two through-holes 22*a* and 22*b* are formed in the front portion of the wood bar 22. The through-holes 22*a*/22*b* are in parallel, and each of the through-holes 22*a*/22*b* is open at both ends thereof on the side surfaces of the wood bar 22 to the outside. The key balancers 24 are inserted into the through-holes 22*a*/22*b* so as to exert the counter moment on the white key 21.

Figure 4:
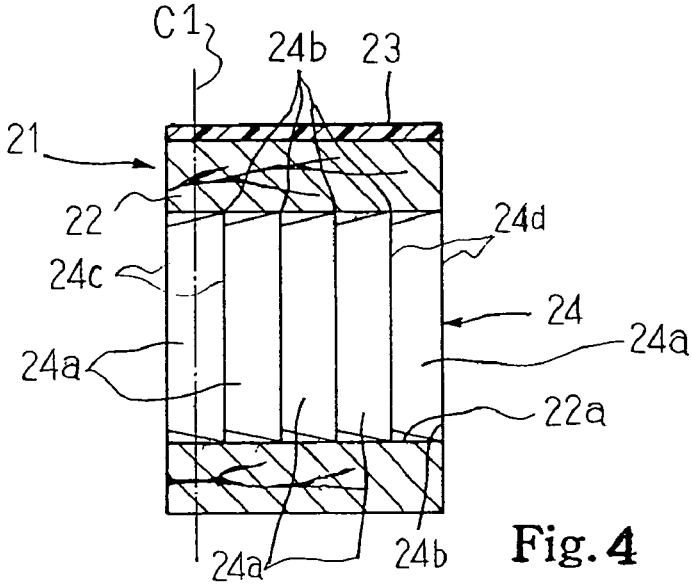
FIG. 4 is a cross sectional view taken along line A—A of FIG. 3 and showing a key balancer embedded in the white key.

The key balancers 24 have a contour like an aggregate of frusto-conical pieces 24*a* as shown in FIG. 4. The pieces of frustum of cone, i.e., frusto-conical pieces 24 have respective centerlines aligned with one another. The frusto-conical piece 24*a* is asymmetrical with respect to a cross section passing through the middle point on the centerline and parallel to the top and bottom circular planes thereof. For example, the leftmost frusto-conical piece 24*a* is asymmetrical with respect to the cross section C1 passing through the middle point on the centerline. The bottom circular plane is wider than the top circular plane so that sharp ridges 24*b* take place along the centerline of the key balancer 24 at regular intervals. Although the top circular planes 24*c* are narrower than the cross sections of the through-holes 22*a*/22*b*, the bottom circular planes 24*d* are slightly wider than the cross section so that the key balancers 24 are inserted into the through-holes 22*a*/22*b* through a press fitting as indicated by arrows 25. The sharp ridges 24*b* are preferable for the key balancers 24. However, the diameter of the sharp ridges is to be slightly larger than the inner diameter of the through-holes 22*a*/22*b*. If the sharp ridges 24*b* have a diameter much larger than the inner diameter of the through-holes 22*a*/22*b*, the wood bar 22 would be cracked during the press fitting. Although the sharp ridges 24*b* make the through-holes 22*a*/22*b* wider than the cross section of the original through-holes 22*a*/22*b* during the press fitting, the key balancers 24 are not pulled out from the through-holes 22*a*/22*b*, because the sharp ridges 24*b* bite the inner wall portions of the wood bar 22. Moreover, the key balancers 24 do not proceed further into the through-holes 22*a*/22*b*, because the remaining parts of the through-holes 22*a*/22*b* still have the cross section smaller in diameter than the sharp ridges 24*b*.

The key balancer 24 is made of heavy metal except harmful metal such as lead and mercury. The heavy metal available for the key balancers 24 are, by way of example, iron, brass, tungsten and sintered metal. Composite material is also available for the key balancers 24. The composite material contains the heavily metal and synthetic resin. Although any sort of non-harmful metal is available for the key balancers 24, tungsten is preferable. Tungsten has the specific gravity of 19.24, and is heavier than lead. Even though the synthetic resin is mixed with tungsten, the composite material has the specific gravity as large as lead. The composite material is to be larger in hardness than the wood bar 22. The synthetic resin available for the key balancers 24 is, by way of example, thermosetting resin in the urethane series, polyester series, epoxy series, phenol series, urea series and melamine series or thermoplastic resin in the ABS (Acrylonitrile-Butadiene-Styrene) series and acrylic resin series. It is preferable to increase the amount of heavy metal of the composite material, because the key balancers 24 exert large counter moment on the key 21. In case where the key balancers 24 are made of iron, the exposed surfaces of the key balancers 24 are to be preserved.

The key 21 is assembled as follows. The through-holes 22*a*/22*b* are formed in the wood bar 22, and the centerline of each key balancer 24 is roughly aligned with the centerline of associated one of the through-holes 22*a*/22*b*. The key balancer 24 is partially inserted into the associated through-hole 22*a*/22*b*. However, the first sharp ridge 24*b* does not allow the key balancer 24 to proceed into the through-hole 22*a*/22*b*. Then, the worker presses the key balancer 24 to the wood bar 22. The key balancer 24 is pushed into the through-hole 22*a*/22*b*, and the sharp ridges 24*b* are strongly caught on the inner surface of the wood bar 22. The worker repeats the press fitting for the other key balancer 24. It is difficult to pull out the key balancers 24 from the through-holes 22*a*/22*b*, because the sharp ridges 24*b* bite the inner wall portions defining the wood bar 22.

In this instance, the sharp ridges 24*b* serve as anchors. As will be understood from the foregoing description, the anchors, i.e., the sharp ridges 24*b* strongly bite the inner wall portions of the wood bar 22, and prevent the key balancers 24 from dropping out from the key 21.

Figure 5:
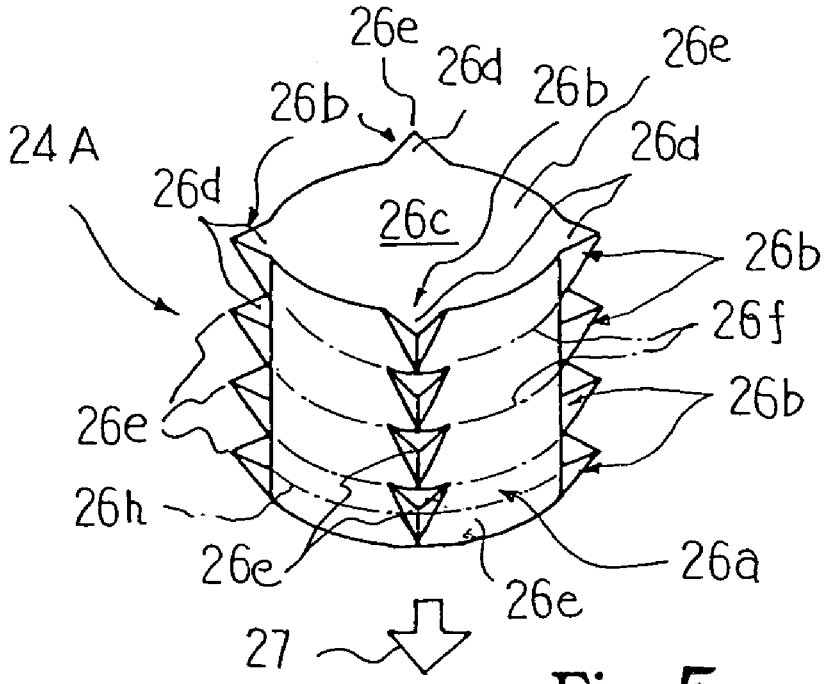
FIG. 5 is a perspective view showing the first modification of the key balancer according to the present invention.

FIG. 5 shows the first modification 24A of the key balancer 24. The key balancer 24A is made of the heavy metal except the harmful metal such as lead and mercury. Iron, brass, tungsten and sintered metal are available for the key balancer 24A. The composite material, which contains the non-harmful metal and synthetic resin, is also available for the key balancer 24A.

The key balancer 24A has a trunk portion 26*a* and sharp teeth 26*b*. The sharp teeth 26*b* are arranged in four columns, and each column of sharp teeth 26*b* is 90 degrees spaced from the adjacent columns of sharp teeth 26*b*. The sharp tooth 26*b* has a pyramid shape. The bottom surfaces 26*d* of the pyramid shaped teeth 26*b* are coplanar with or in parallel to the end surfaces 26*c* of the trunk portion 26*a* so that sharp tips 26*e* take place.

The key balancer 24A is imaginarily dividable into plural parts 26*e* as indicated by phantom lines 26*f*. Each part 26*e* includes four sharp teeth 26*b* 90 degrees spaced from one another, and is asymmetrical with respect to a virtual cross section 26*h*.

The key balancer 24A is inserted into the through-holes 22*a*/22*b* as indicated by arrow 27. The sharp tips 26*e* bite the inner wall portions of the wood bar 22 so that the key balancers 24A are stable in the through-holes 22*a*/22*b*. In the first modification, the sharp tips 26*e* serve as anchors.

Figure 6:
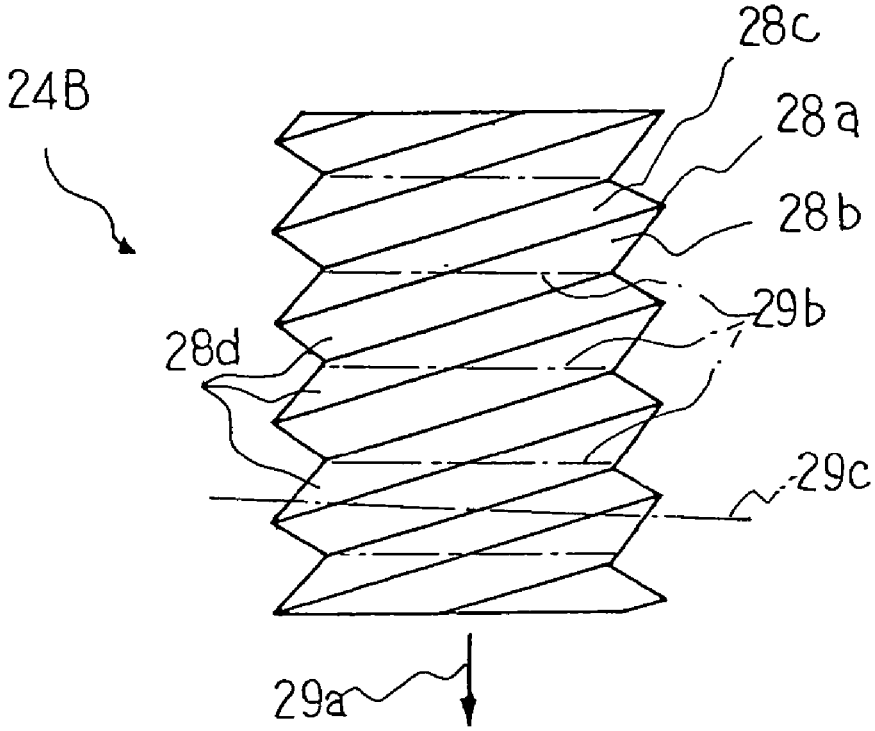
FIG. 6 is a front view showing the second modification of the key balancer according to the present invention.

FIG. 6 shows the second modification 24B of the key balancer 24. The key balancer 24B is made of the heavy metal except the harmful metal such as lead and mercury. Iron, brass, tungsten and sintered metal are available for the key balancer 24B. The composite material, which contains the non-harmful metal and synthetic resin, is also available for the key balancer 24B.

The key balancer 24B has a generally column shape, and a spiral ridge 28*a* is formed in the outer surface portion. The spiral ridge 28*a* is defined by two spiral surfaces 28*b* and 28*c*. In this instance, the spiral ridge 28*a* has a triangular cross section. However, the key spiral ridge 28*a* may have a rectangular cross section or another polygonal cross section. The spiral ridge 28*a* is either left-handed or right-handed. If the key balancer 24B is inserted into the through-holes formed in the key in the direction indicated by arrow 29*a*, it is preferable that the spiral surface 28*b* inclines larger in angle than the other spiral surface 28*c*, because the spiral ridge 28*a* strongly bites the inner surface portion of the key in the motion reverse to the arrow 29*a*.

The key balancer 24B is also imaginarily dividable into plural parts 28*d* as indicated by phantom lines 29*b*, and each part 28*d* is asymmetrical with respect to a virtual cross section 29*c* at the mid point of the centerline and parallel to the both end surfaces of the key balancer 24B.

A worker embeds the key balancers 24B in the key as follows. First, the worker forms through-holes 22*a*/22*b* in the wood bar 22, and roughly aligns the centerline of the key balancer 24B with the centerline of the through-hole 22*a*. The worker drives the key balancer 24B for rotation. Then, the key balancer 24B advances into the through-hole 22*a* through the screw-motion. The worker repeats the operations for the other key balancers 24B. Even if the key balancer 24B is rearward pulled, the sharp ridge 28*a* bites the inner surface portion of the key 21, and prevents the key balancer 24B from being dropped out.

Figure 7:
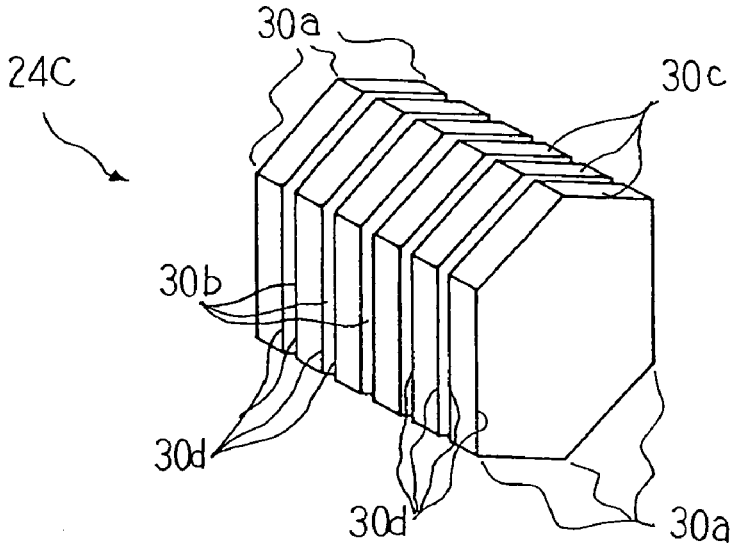
FIG. 7 is a perspective view showing the third modification of the key balancer according to the present invention.

FIG. 7 shows the third modification 24C of the key balancer 24. The key balancer 24C is also made of the heavy metal except the harmful metal such as lead and mercury. Iron, brass, tungsten and sintered metal are available for the key balancer 24C. The composite material, which contains the non-harmful metal and synthetic resin, is also available for the key balancer 24C.

The key balancer 24C has a generally a hexagonal column, and, accordingly, six ridges 30*a* take place along the centerline of the hexagonal column. Plural grooves 30*b* are formed in the hexagonal column so that plural hexagonal parts 30*c* are spaced from one another along the centerline at intervals. The grooves 30*b* do not reach the centerline so that the plural hexagonal parts 30*c* are integral. The plural hexagonal parts 30*c* have sharp peripheries 30*d*.

The key balancers 24C are embedded in the key 21 as follows. A worker forms the through-holes 22*a*/22*b* in the wood bar 22, and roughly aligns the centerline of the key balancer 24C with the centerline of the through-hole 22*a*/22*b*. The worker forcibly inserts the key balancer 24C into the through-hole 22*a*/22*b* through a press fitting. Even if the key balancer 24C is rearward pulled, the sharp peripheries 30*d* bite the inner surface portion of the key 21, and the key balancer 24C is hardly moved in the rearward direction. The six ridges 30*a* prevent the key balancers 24C from rotation in the through-holes 22*a*/22*b*.

Figure 8A:
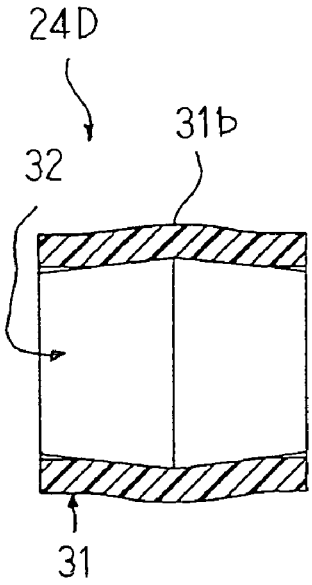
FIGS. 8A and 8B are a cross sectional view and a perspective view showing the fourth modification of the key balancer according to the present invention.
Figure 8B:
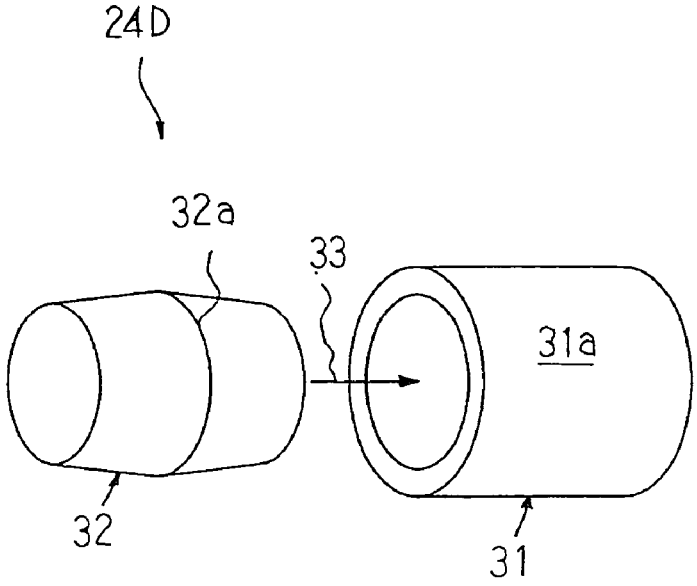

FIGS. 8A and 8B show the fourth modification 24D of the key balancer 24. The key balancer 24D is a combination of a resilient tubular member 31 and a weight piece 32. The weight piece 32 is made of the heavy metal except the harmful metal such as lead and mercury. Iron, brass, tungsten and sintered metal are available for the key balancer 24D. The composite material, which contains the non-harmful metal and synthetic resin, is also available for the key balancer 24D.

The weight piece 32 has a shape like a barrel. The weight piece 32 is increased in cross section from one end toward a middle section along the centerline thereof, and is decreased in cross section from the middle section to the other end. Thus, the weight piece 32 is tapered from the middle section toward both ends, and a ridge 32*a* is formed. The maximum diameter on the middle section is slightly larger than the diameter of the through-holes 22*a*/22*b*.

On the other hand, the resilient tubular member 31 is approximately equal in diameter to the through-holes 22*a*/22*b*. While the weight piece 32 is out of the tubular member 31, the tubular member 31 has a straight outer surface 31*a* as shown in FIG. 8B. However, when the weight piece 32 is received in the tubular member 31, the resilient tubular member 31 is partially bulged as shown in FIG. 8A.

The key balancer 24D is embedded in the key 21 as follows. First the through-holes 22*a*/22*b* are formed in the wood bar 22, and the resilient tubular members 31 are inserted into the through-holes 22*a*/22*b*, respectively. The worker roughly aligns the centerline of the weight piece 32 with the centerline of the resilient tubular member 31. The worker forcibly inserts the weight pieces 32 into the resilient tubular members 31 through a press fitting. The resilient tubular members 31 are partially bulged due to the ridge 32*a*, and are strongly pressed to the inner surfaces of the wood bar 22. The bulged portion 31*b* of the resilient tubular member 31 prevents the key balancer 24D from being dropped out. In this instance, the bulged portion 31*b* and ridge 32*a* serve as an anchor. The weight piece or pieces 32 may be used as the fifth modification of the key balancer 24.

As will be understood from the foregoing description, the key balancers 24/24A/24B/24C/24D have the anchors 24*b*, 26*b*, 28*a*, 30*d* and 31*b*/32*a* so that the key balancers 24/24A/24B/24C/24D are hardly dropped out from the through-holes without any adhesive compound. Especially, the anchors 24*b*, 26*b* and 30*b* are asymmetrical with respect to the virtual cross sections C1/26*h*/29*c* of the unit portions 24*a*, 26*e* and 28*d*, and, accordingly, are sharp. This results in that the sharp anchors 24*b*/26*b*/30*d* strongly bite the inner surface portions of the wood bars 22. Thus, the anchors 24*b*/26*b*/30*d* keep the key balancers 24/24A/24B stable in the through-holes.

The key balancers 24/24A/24B/24C/24D are inserted into the through-holes 22*a*/22*b* through the press fitting or screw motion. The assembling work is simple and easy. This results in reduction of the production cost.

The key balancers 24/24A/24B do not contain any harmful element, and are desirable from the viewpoint of the human health and safety environment.

Second Embodiment

Figure 9:
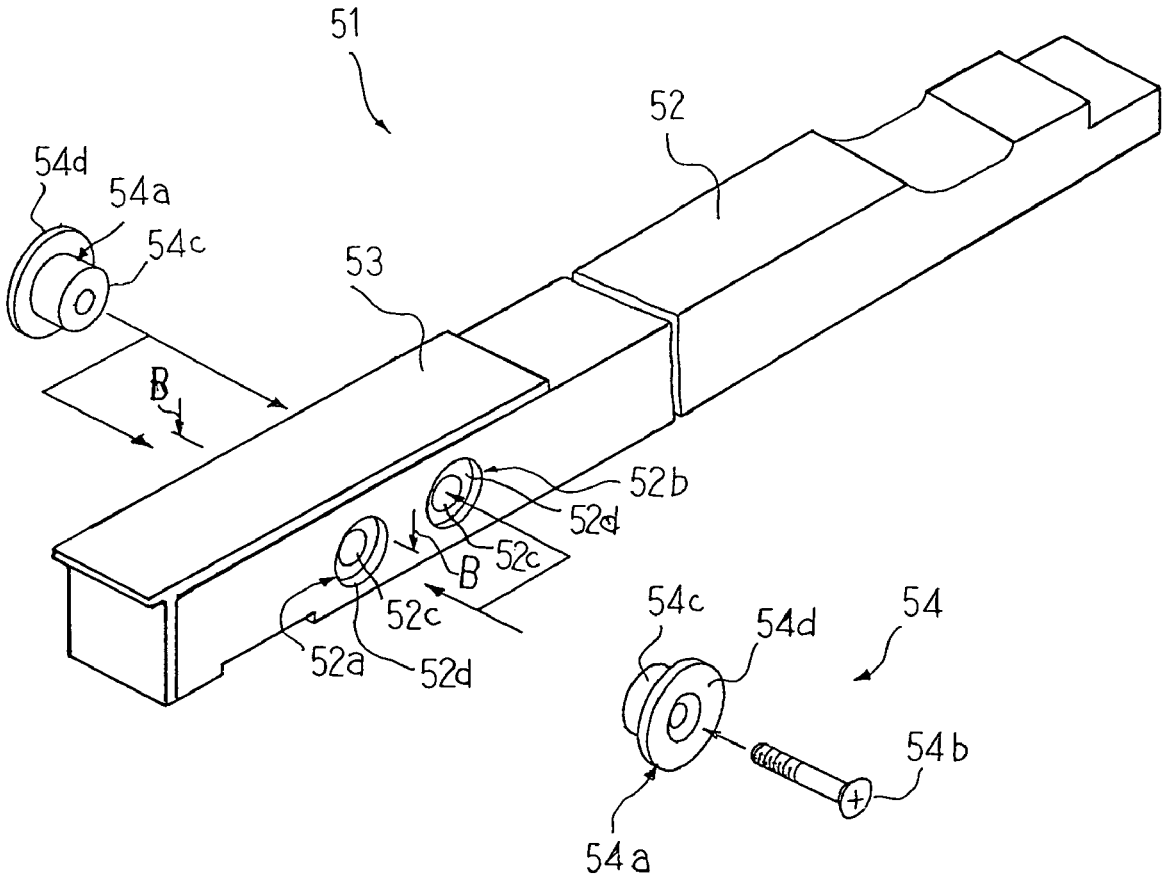
FIG. 9 is a perspective view showing a white key incorporated in another acoustic piano according to the present invention.

FIG. 9 shows a key 51 forming a part of a keyboard, which is incorporated in an acoustic piano. The acoustic piano is similar to that shown in FIG. 1 except the keys 51. For this reason, description is focused on the key 51, and the other component parts are specified by using references designating corresponding parts in FIG. 1.

The key 51 serves as a white key, and comprises a wood bar 52, a decorative plate 53 and key balancers 54. The wood bar 52 is made of Japanese spruce, which belongs to silver fir. Although a front portion and a rear portion are shown in FIG. 9, a vertical hole (not shown) is formed in a middle portion of the wood bar 52, and a balance pin (not shown) passes through the vertical hole. The balance pin gives the fulcrum 3*d* to the white key 51 placed on the balance rail 3*b*.

The upper surface and front end surface of the front portion of the white key 51 are covered with the decorative plate 53. The decorative plate 53 is like an angle, and is adhered to the wood bar 52. The decorative plate 53 is made of synthetic resin, and the synthetic resin is colored in white.

Two through-holes 52*a* and 52*b* are formed in the front portion of the wood bar 52. The through-holes 52*a*/52*b* are in parallel, and each of the through-holes 52*a*/52*b* is open at both ends thereof on the side surfaces of the wood bar 52 to the outside. Each of the through-holes 52*a*/52*b* has a narrow portion 52*c* and wide portions 52*d*. As will be seen in FIG. 10, the wide portions 52*d* are exposed to the side surfaces of the wood bar 52, and are formed on both sides of the narrow portion 52*c*. In this instance, the wide portions 52 are equal in depth and diameter to one another. The key balancers 54 are embedded in the through-holes 52*a*/52*b* so as to exert the counter moment on the white key 51.

Figure 10:
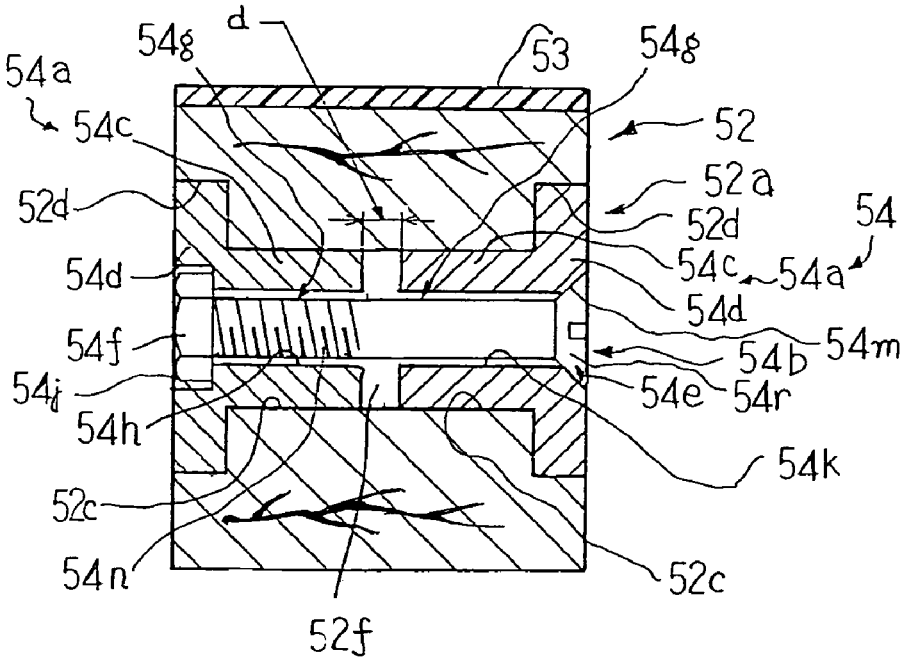
FIG. 10 is a cross sectional view taken along line B—B of FIG. 9 and showing the structure of a key balancer embedded in the white key.

Each of the key balancer 54 includes weight pieces 54*a* and a fastener 54*b*. The fastener 54*b* serves as an anchor. Each of the weight pieces 54*a* has a stem portion 54*c* and a head portion 54*d*. The stem portion 54*c* is approximately equal in diameter to the narrow portion 52*c*, and the length of the stem portion 54*c* is shorter than a half of the length of the narrow portion 52*c*. The head portion 54*d* has the diameter and thickness approximately equal to the diameter and depth of the wide portion 52*d*. The thickness of the head portions 54*d* may be less than the depth of the wide portions 52*d*. The weight pieces 54*a* are inserted into each through-hole 52*a*/52*b* from both side surfaces. The tolerance between the head portions 54*d* and the wide portions 52*d* is fairly large in value so that head portions 54*d* are rather loosely received in the wide portions 52*d*, respectively. Similarly, the tolerance between the stem portions 54*c* and the narrow portion 52*c* is large in value, and the stem portions 54*c* loosely extend in the narrow portion 52*c*. The head portions 54*d* are substantially coplanar with the side surfaces of the wood bar 52. The stem portions 54*c* are spaced from one another in the narrow portion 52*c*. Thus, a gap 52*f* takes place between the stem portions 54*c* as shown in FIG. 10.

A through-hole 54*g* is formed along the centerline of the weight piece 54*a*. The through-hole 54*g* formed in one of the weight piece 54*a* has a narrow portion 54*h*/54*k* and a hexagonal wide portion 54*j*, and the hexagonal wide portion 54*j* and narrow portion 54*h* form a step. On the other hand, the through-hole 54*g* formed in the other weight piece 54*a* has a narrow portion 54*h* and a frusto-conical portion 54*m*. The narrow portion 54*h* is equal in diameter to the narrow portion 54*k*.

The fastener 54*b* includes a flat head bolt 54*e* and a hexagon nut 54*f*. The flat head bolt 54*e* has a threaded stem 54*n*, which is narrower than the narrow portions 54*h*/54*k*, and a head 54*r*. The hexagonal nut 54*f* has the thickness equal to the depth of the hexagonal wide portion 54*j* so that the hexagonal nut 54*f* is received in the hexagonal wide portion 54*j* without projecting from the side surface of the wood bar 52. On the other hand, the head 54*r* is received in the frusto-conical portion 54*m*, and the threaded stem 54*n* extends in the narrow portions 54*k*/54*h*. The hexagon nut 54*f* is engaged with the threaded stem 54*n*, and the weight pieces 54*a* are fastened to the wood bar 52 by means of the flat head bolt 54*e* and hexagon nut 54*f*. Even if the flat head bolt 54*e* is deeply screwed into the hexagon nut 54*f*, the distance d is not decreased to zero, and the hexagon nut 54*f* is not loosened.

Even though the weight pieces 54*a* are loosely fit to the wood bar 52, the fastener 54*b* keeps the weight pieces 54*a* stable in the key 51. Moreover, one of the weight pieces 54*a* are identical with the other weight piece 54*a*, and both weight pieces 54*a* are made of certain material described hereinafter in detail. Although the head portion 54*r* is different in weight from the hexagon nut 54*f*, the weight pieces 54*a* have the weight much greater than the difference in weight between the head portion 54*r* and the hexagon nut 54*f*, and the key 51 is never twisted due to the unbalance. If the flat head bolt is replaced with a hexagonal headed bolt, the different in weight is minimized.

The weight pieces 54*a* are made of heavy metal except harmful metal such as lead and mercury. The heavy metal available for the weight pieces 54*a* is, by way of example, iron, brass, tungsten and sintered metal. Composite material is also available for the weight pieces 54*a*. The composite material contains the heavily metal and synthetic resin. Although any sort of non-harmful metal is available for the weight pieces 54*a*, tungsten is preferable. Tungsten has the specific gravity of 19.3, and is heavier than lead. Even though the synthetic resin is mixed with tungsten, the composite material has the specific gravity as large as or larger than lead. The composite material is to be larger in hardness than the wood bar 52. The synthetic resin available for the weight pieces 54*a* is, by way of example, thermosetting resin in the urethane series, polyester series, epoxy series, phenol series, urea series and melamine series or thermoplastic resin in the ABS (Acrylonitrile-ButadieneStyrene) series and acrylic resin series. It is preferable to increase the amount of heavy metal of the composite material, because the weight pieces 54*a* exert large counter moment on the key 51. In case where the weight pieces 54*a* are made of iron, the exposed surfaces of the weight pieces 54*a* are to be preserved.

As will be understood from the foregoing description, the acoustic piano according to the present invention includes the key 51, in which the fasteners 54*b* keep the key balancers 54 stable. The fastener 54*b*, i.e., anchors permit a worker to embed the weight key balancers 54 in the wood bar 52 easily. In case where the fastener 54*b* is implemented by the combination of the bolt 54*e* and nut 54*f*, the worker easily disassemble the key balancers 54 from the wood bar 52. The key balancers 54 are not made of any harmful material so that the key balancers are preferable from the viewpoint of the health and environment.

Figure 11:
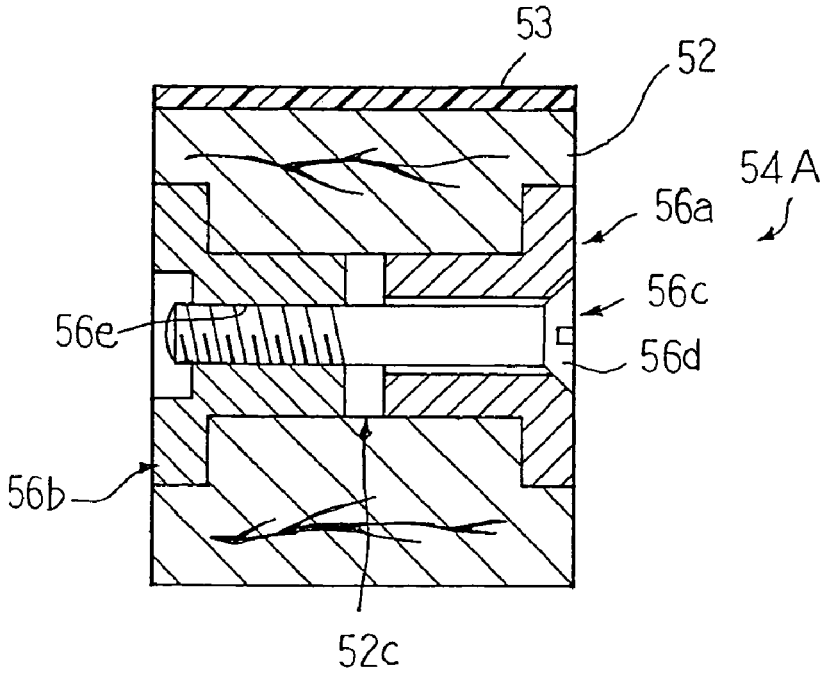
FIG. 11 is a cross sectional view showing the first modification of the key balancer shown in FIG. 10.
Figure 1:
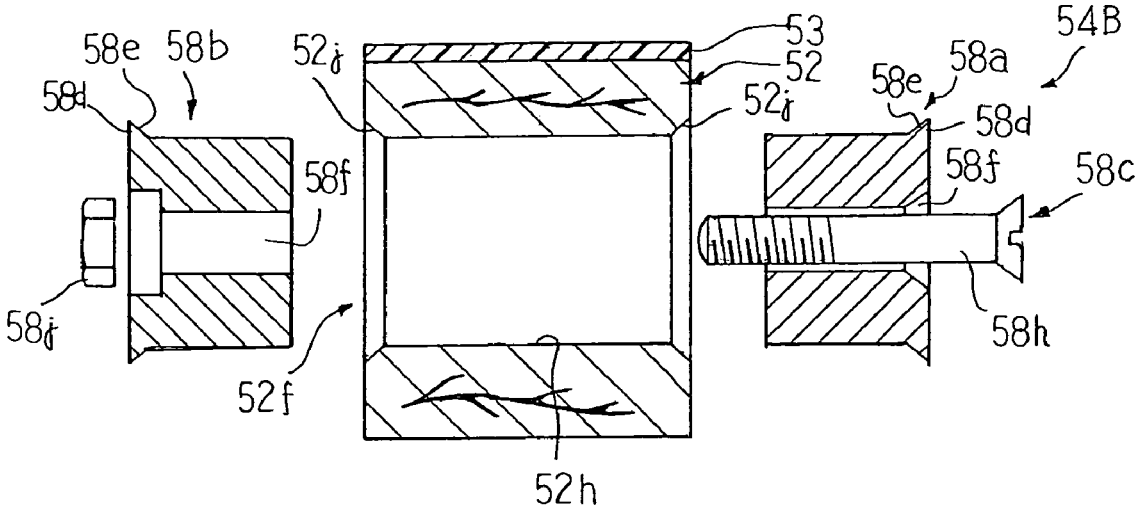
Figure 1:
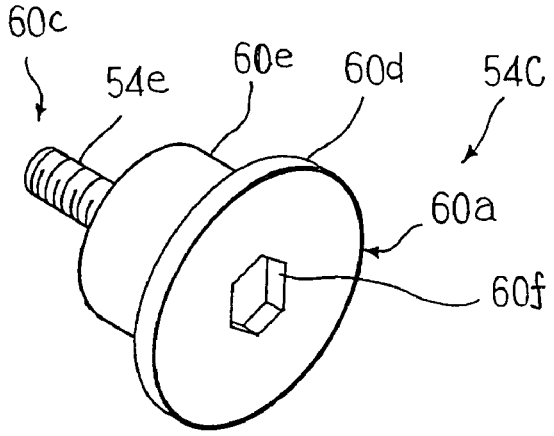
Figure 1:
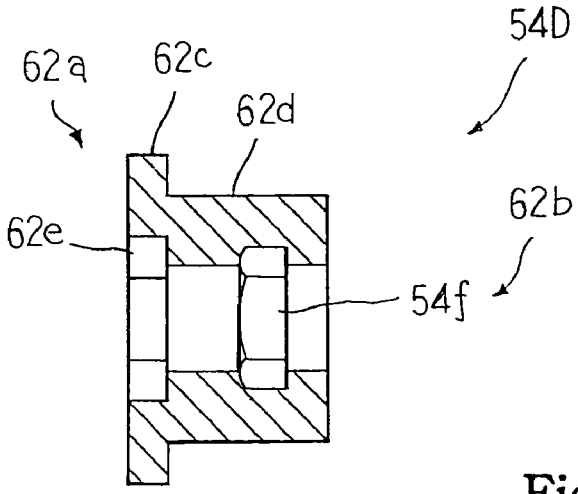
Figure 1:
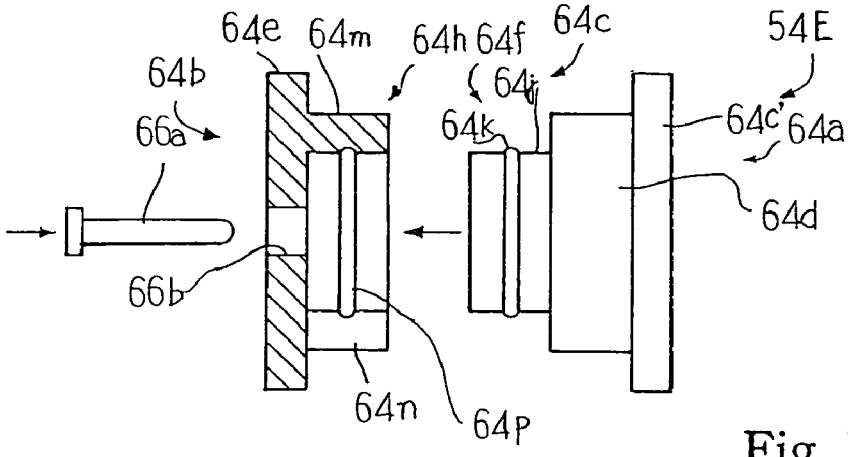
Figure 1:
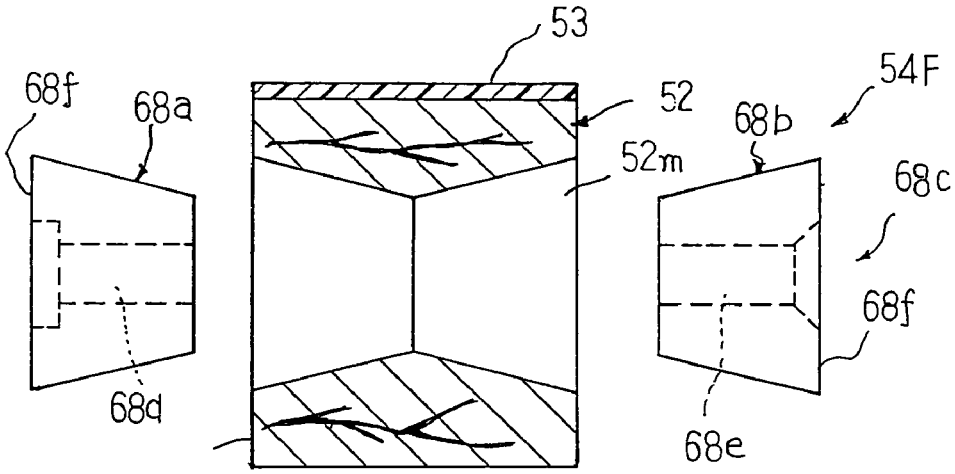
Figure 1:
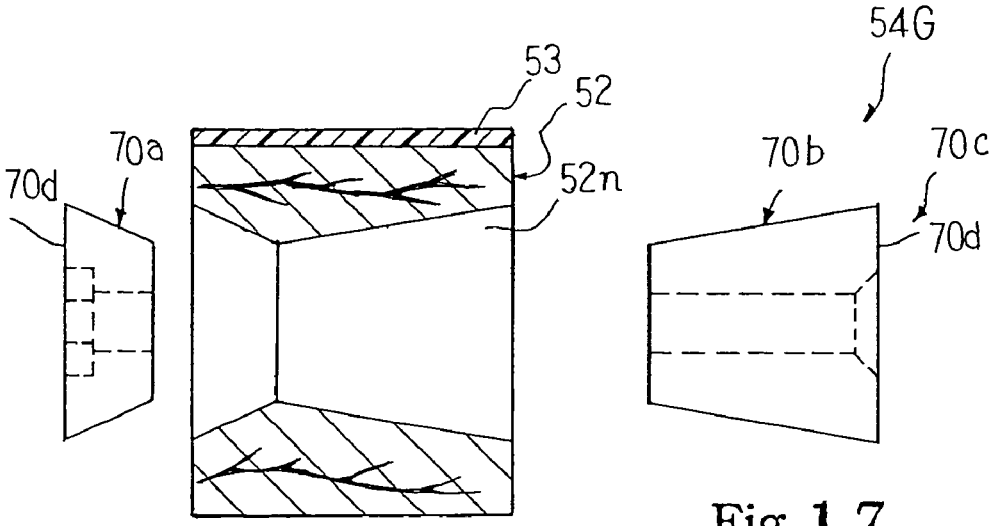
Figure 1:
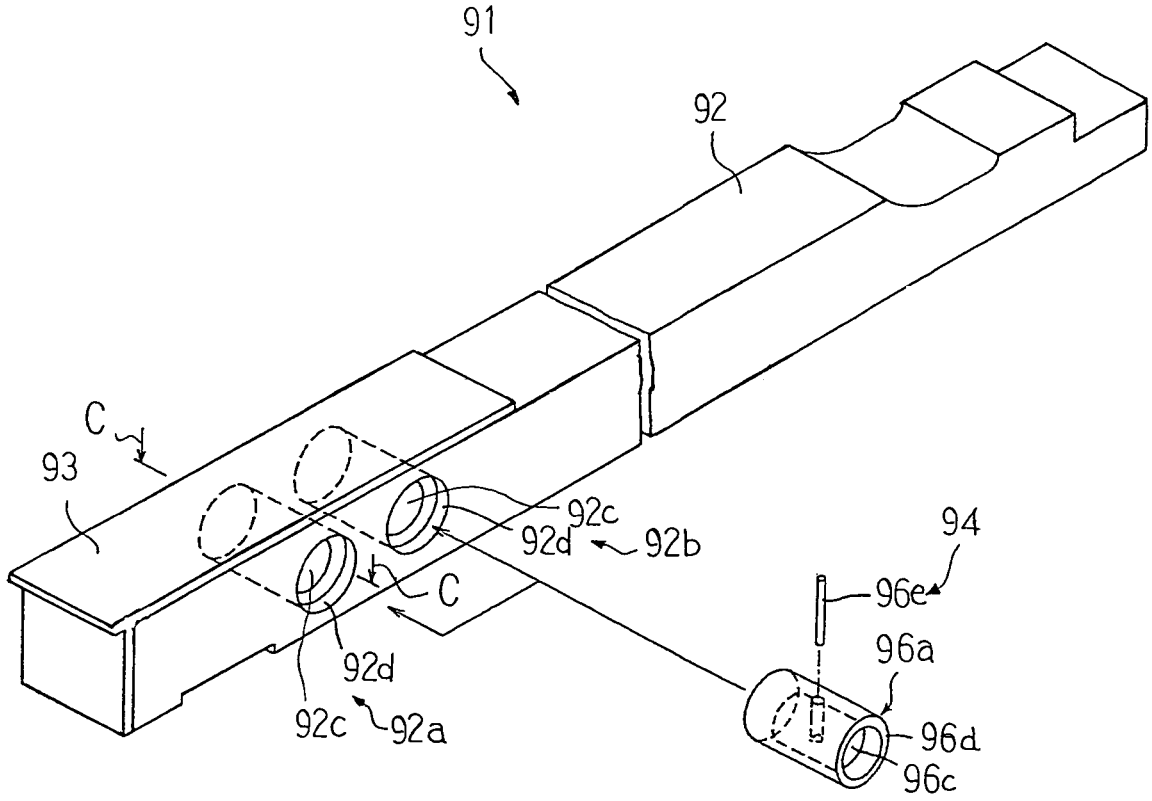

There are various modifications. FIG. 11 shows the first modification 54A of the balancer 54. The key balancer 54A also includes weight pieces 56*a*/56*b* and a fastener 56*c*. The weight piece 56*a* is same as the weight piece 54*a*. However, the other weight piece 56*b* and fastener 56*c* are different from the weight piece 54*a* and fastener 54*b*, respectively. The fastener 56*c* is implemented by only the flat-head bolt 56*d*, and the female screw 56*e* is formed in the inner surface portion of the weight piece 56*b*. The flat head bolt 56*d* is engaged with the female screw 56*e* so that the weight pieces 56*a*/56*b* are fastened to the wood bar 52. The fastener 56*c* is constituted by only one part 56*d* so that the production cost is reduced.

FIG. 12 shows the second modification 54B of the key balancer 54. The key balancer 54B includes weight pieces 58*a*/58*b* and a fastener 58*c*. The fastener 58*c* serves as an anchor. A through-hole 52*f* is formed in the wood bar 52, and has a straight portion 52*h* and tapered portions 52*j*. The tapered portions 52*j* are formed on both ends of the straight portion 52*h*, and are exposed to the side surfaces of the wood bar 52. The weight pieces 58*a*/58*b* have respective brim portions 58*d*, which have tapered surfaces 58*e*, respectively. The weight pieces 58*a*/58*b* are received in the through-holes 52*f*, and the tapered surfaces 58*e* are held in face-to-face contact with the inner surfaces defining the tapered portions 52*j*, respectively. The weight pieces 58*a*/58*b* are spaced from one another in the through-hole 52*f*.

Through-holes 58*f* are formed in the weight pieces 58*a*/58*b*. The through-hole 58*f* in the weight piece 58*a* is stepwise varied in the diameter, and the other through-hole 58*f* is partially tapered. The fastener 58*c* is implemented by a flat head bolt 58*h* and a hexagon nut 58*j*. The hexagon nut 58*j* is received in the stepwise varied through-hole 58*f*, and the flat head bolt 58*h* is inserted into the other through-holes 58*f*. The hexagon nut 58*j* is engaged with the threaded stem of the flat head bolt 58*h*. Thus, the weight pieces 58*a*/58*b* are fastened to the wood bar 52 by means of the fastener 58*c*.

FIG. 13 shows the third modification 54C of the key balancer 54. The key balancer 54C includes a weight piece 60*a*, the weight piece 54*a* (not shown in FIG. 13) and a fastener 60*c*. The fastener 60*c* is implemented by the combination of flat head bolt 54*e* and hexagon nut 54*f* (not shown in FIG. 13). The weight piece 60*a* has a head 60*d* and a stem 60*e*. The flat head bolt 54*e* is embedded in the stem 60*e* through an insert molding, and the bolt 54*e* projects from the stem 60*e* as shown. A hexagonal recess 60*f* is formed in the head 60*d*, and a hexagonal wrench is to be snugly received in the hexagonal recess 60*f*. When the key balancer 54C is assembled with the wood bar 52, the weight piece 54*a* is inserted into the through-hole 52*a*/52*b*, and the hexagon nut 54*f* is received in the wide portion 54*j*. The weight piece 60*a* is partially inserted into the through-hole 52*a*/52*b*, and is rotated by a worker with the wrench. Then, the flat head bolt 54*e* is engaged with the hexagon nut 54*f*, and the weight pieces 60*a*/54*a* are fastened to the wood bar 52. Thus, the bolt 54*e* and hexagon nut 54*f*, i.e., the fastener serve as the anchor.

FIG. 14 shows the fourth modification 54D of the key balancer 54. The key balancer 54D includes a weight piece 62*a*, the weight piece 54*a* and a fastener 62*b*. The fastener 62*b* is implemented by the combination of the bolt 54*e* and nut 54*f*. The hexagonal nut 54*f* is embedded in the weight piece 62*a* through the insert molding. The weight piece 62*a* has a head portion 62*c* and a stem portion 62*d*, and a hexagonal recess 62*e* is formed in the head portion 62*c*. The weight pieces 62*a*/54*a* are inserted into the through-hole 52*a*/52*b*, and the worker keeps the weight piece 62*a* stable with a wrench inserted into the hexagonal recess 62*e*. The worker drives the flat headed bolt 54*e* for rotation, and the bolt 54*e* is engaged with the nut 54*f*.

The weight pieces 60*a*/62*a* and the fastener 54*e*/54*f* may form the fifth modification of the key balancer 54. In this instance, a worker inserts the weight pieces 60*a*/62*a* into the through-hole 52*a*/52*b*, and drives one of the weight pieces 60*a*/62*a* for rotation with a wrench. The fifth modification is desirable, because the bolt and nut are not carelessly lost.

FIG. 15 shows the sixth modification 54E of the key balancer 54. The key balancer 54E includes weight pieces 64*a*/64*b* and a fastener 64*c*. The fastener 64*c* are integral with the weight pieces 64*a*/64*b* as will be described hereinafter in detail. The weight piece 64*a* has a head portion 64*c*' and a stem portion 64*d*, and the other weight piece 64*b* is implemented by a disc 64*e*. The head portion 64*c*' and disc 64*e* are received in the wide portions 52*d* of the through-hole 52*a*/52*b*, respectively, and the stem portion 64*d* is inserted into the narrow portion 52*f* of the through-hole 52*a*/52*b*.

The fastener 64*c* is implemented by a projection 64*f* and a receiver 64*h*. The projection 64*f* has a stem 64*j* and a ring 64*k*. The stem 64*j* is formed with the ring 64*k*. The ring 64*k* extends along the periphery of the stem 64*j*. The receiver 64*h* is implemented by a cylinder 64*m*, and the cylinder 64*m* is open at one end to the outside. The outer diameter of the cylinder 64*m* is equal to the inner diameter of the narrow portion 52*f* of the through-hole 52*a*/52*b*, and the inner diameter of the cylinder 64*m* is equal to the outer diameter of the stem 64*j*. Plural slits 64*n* are formed in the cylinder 64*m* so that the cylinder 64*m* is radially outwardly widened. A ring-shaped groove 64*p* is formed along the inner surface defining the inner space of the cylinder 64*m*, and the ring 64*k* is to be received in the ring-shaped groove 64*p*.

When a worker is embedded in the wood bar 52, the worker inserts the weight pieces 64*a*/64*b* from both side surfaces of the wood bar 52 into the through-hole 52*a*/52*b*. The stem 64*j* advances into the inner space of the cylinder 64*m*, and the ring 64*k* is brought into contact with the cylinder 64*m*. The worker strongly pushes the weight pieces 64*a*/64*b*. Then, the ring 64*k* causes the cylinder 64*m* to be outwardly radially deformed so that the ring 64*k* reaches the ring-shaped groove 64*p*. The ring 64*k* is received in the ring-shaped groove 64*p*, and the cylinder 64*m* is recovered to the initial configuration. The ring 64*k* is hardly moved out of the ring-shaped groove 64*p*. Thus, the fastener 64*c* keeps the key balancer 54E in the through-hole 52*a*/52*b* stable.

When the worker disassembles the key balancer 54E, the worker inserts a pin 66*a* into a hole 66*b* formed in the weight piece 64*b*, and hits the head portion of the pin 66*a*. Then, the ring 64*k* is moved out of the ring-shaped groove 64*p*, and the projection 64*f* is separated from the receiver 64*h*. The worker takes out the weight pieces 64*a*/64*b* from the through-hole 52*a*/52*b*.

FIG. 16 shows the seventh modification 54F of the key balancer 54. The key 52 is formed with a through-hole 52*m* instead of the through-hole 52*a*/52*b*. The through-hole 52*m* is increased in cross section from the middle point toward both ends thereof. Thus, the through-hole 52*m* is symmetrical with respect to a virtual cross section perpendicular to the middle point of the centerline thereof. The key balancer 54F includes weight pieces 68*a*/68*b* and a fastener 68*c*. The weight pieces 68*a*/68*b* is shaped in a frusto-conical configuration, and through-holes 68*d*/68*e* are formed in the weight pieces 68*a*/68*b*, respectively. The through-hole 68*d* is stepwise varied in diameter, and the other through-hole 68*e* is partially tapered. The flat headed bolt 54*e* and hexagon nut 54*f* serve as the fastener 68*c*, and are engaged with one another in the through-holes 68*d*/68*e*. When the weight pieces 68*a*/68*b* are inserted into the through-hole 52*m*, the weight pieces 68*a*/68*b* are held in face-to-face contact with the inner surface defining the through-hole 52*m*, and the bottom surfaces 68*f* are coplanar with the side surfaces of the wood bar 52. The weight pieces 68*a*/68*b* are spaced from each other in the through-hole 52*m*. The weight pieces 68*a*/68*b* are fastened to the wood bar 52 by means of the bolt and nut 54*e*/54*f*.

FIG. 16 shows the eighth modification 54G of the key balancer 54. The wood bar 52 is formed with a through-hole 52*n* instead of the through-hole 52*a*/52*b*. Although the through-hole 52*n* is also tapered toward the side surfaces of the wood bar 52, the cross section is minimized at a certain point leftward offset from the middle point. For this reason, the tapered inner surface is asymmetrical with respect to a virtual cross section passing through the certain point on the centerline of the through-hole 52*n*, and the tapered inner surface on the left side of the virtual cross section is different in angle from the tapered inner surface on the right side.

The key balancer 54G includes weight pieces 70*a*/70*b* and a fastener 70*c*. The weight pieces 70*a* and 70*b* have respective frusto-conical configurations different from each other. The weight piece 70*a* is to be inserted into the left portion of the through-hole 52*n*, and the other weight piece 70*b* is to be received in the right portion of the through-hole 52*n*. When the weight pieces 70*a*/70*b* are inserted into the through-hole 52*n*, the weight pieces 70*a*/70*b* are held in face-to-face contact with the tapered inner surfaces defining the through-hole 52*n*, and the bottom surfaces 70*d* are coplanar with the side surfaces of the wood bar 52. The fastener 70*c* is implemented by the bolt 54*e* and nut 54*f*. When the bolt 54*e* is engaged with the nut 54*f*, the weight pieces 70*a*/70*b* are fastened to the wood bar 52.

Those modifications 54A/54B/54C/54D/54E/54F/54G achieve all the advantage of the key balancer 54.

Third Embodiment

Turning to FIG. 18 of the drawings, a key 91 forming a part of a keyboard, which is incorporated in an acoustic piano. The acoustic piano is similar to that shown in FIG. 1 except the keys 91. For this reason, description is focused on the key 91, and the other component parts are specified by using references designating corresponding parts in FIG. 1.

The key 91 serves as a white key, and comprises a wood bar 92, a decorative plate 93 and key balancers 94. The wood bar 92 is made of Japanese spruce, which belongs to silver fir. Although a front portion and a rear portion are shown in FIG. 18, a vertical hole is formed in a middle portion of the wood bar 92, and a balance pin (not shown) passes through the vertical hole. The balance pin gives the fulcrum 3*d* to the white key 91 placed on the balance rail 3*b*.

The upper surface and front end surface of the front portion of the wood bar 92 are covered with the decorative plate 93. The decorative plate 93 is like an angle, and is adhered to the wood bar 92. The decorative plate 93 is made of synthetic resin, and the synthetic resin is colored in white.

Figure 19:
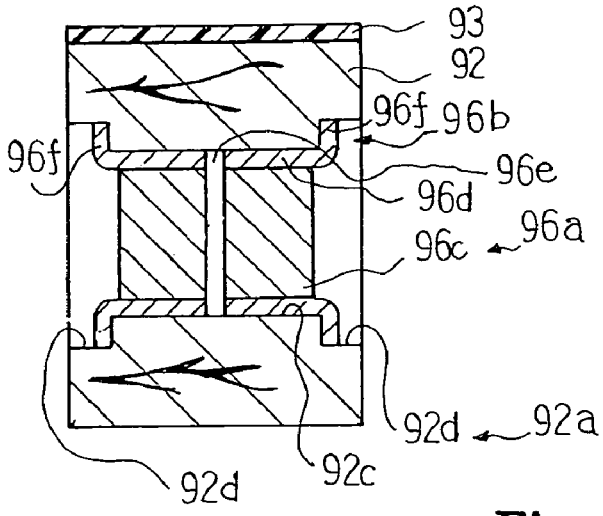
FIG. 19 is a cross sectional view taken along line C—C of FIG. 18 and showing a key balancer in the white key.

Two through-holes 92*a* and 92*b* are formed in the front portion of the wood bar 92. The through-holes 92*a*/92*b* are in parallel, and each of the through-holes 92*a*/92*b* is open at both ends thereof on the side surfaces of the wood bar 92 to the outside. Each of the through-holes 92*a*/92*b* has a narrow portion 92*c* and wide portions 92*d*. As will be seen in FIG. 19, the wide portions 92*d* are exposed to the side surfaces of the wood bar 92, and are formed on both sides of the narrow portion 92*c*. In this instance, the wide portions 92 are equal in depth and diameter to one another. The key balancers 94 are embedded in the through-holes 92*a*/92*b* so as to exert the counter moment on the white key 91.

Each of the key balancers 94 includes a weight piece 96*a* and a fastener 96*b*. The weight piece 96*a* has a weight column piece 96*c*, a tube 96*d* and a pin 96*e*. The tube 96*d* is equal in diameter to the narrow portion 92*c*, and is flared at both end portions 96*f*. The flared end portions 96*f* are larger in diameter than the narrow portion 92*c*, and serves as the fastener 96*b*. On the other hand, the outer diameter of the weight column 96*c* is equal to or slightly less than the inner diameter of the tube 96*d*, and the length of the weight column 96*c* is equal to the length of the narrow portion 92*c*. Holes are formed in both tube and weight column 96*c*/96*d*, and are equal in diameter to or slightly less than the pin 96*e*.

The tube, weight column and pin 96*d*/96*c*/96*e* are assembled into the weight piece 96*a* as follows. The weight column and tube 96*c*/96*d* are drilled. The weight column 96*c* is inserted into the tube 96*d*, and the hole formed in the tube 96*d* is aligned with the hole formed in the weight column 96*c*. The pin 96*e* is driven into the holes so that the weight column 96*c* is fixed to the tube 96*d* by means of the pin 96*e*. Otherwise, the weight column 96*c* is inserted into the tube 96*d*, and the weight column and tube 96*d*/96*d* are concurrently drilled so that the holes are formed therein. The pin 96*e* is driven into the holes, and the weight column 96*c* is fixed to the tube 96*d*.

The weight column 96*c* is made of heavy metal except harmful metal such as lead and mercury. The heavy metal available for the weight column 96*c* is, by way of example, iron, brass, tungsten and sintered metal. Composite material is also available for the weight column 96*c*. The composite material contains the heavily metal and synthetic resin. Although any sort of non-harmful metal is available for the key weight column 96*c*, tungsten is preferable. Tungsten has the specific gravity of 19.3, and is heavier than lead. Even though the synthetic resin is mixed with tungsten, the composite material has the specific gravity as large as or larger than lead. The synthetic resin available for the composite material is, by way of example, thermosetting resin in the urethane series, polyester series, epoxy series, phenol series, urea series and melamine series or thermoplastic resin in the ABS (Acrylonitrile-Butadiene-Styrene) series and acrylic resin series. It is preferable to increase the amount of heavy metal of the composite material, because the weight column 96*c* exerts large counter moment on the key 91. In case where the weight column 96*c* is made of iron, the exposed surfaces of the weight column 96*c* are to be preserved.

The tube 96*d* is made of metal such as, for example, copper or brass in order to make the tube 96*d* sufficiently deformed. Otherwise, the tube 96*d* is made of composite material containing metal and synthetic resin. Any metal except the harmful metal such as lead and mercury is available for the composite material.

Figure 20:
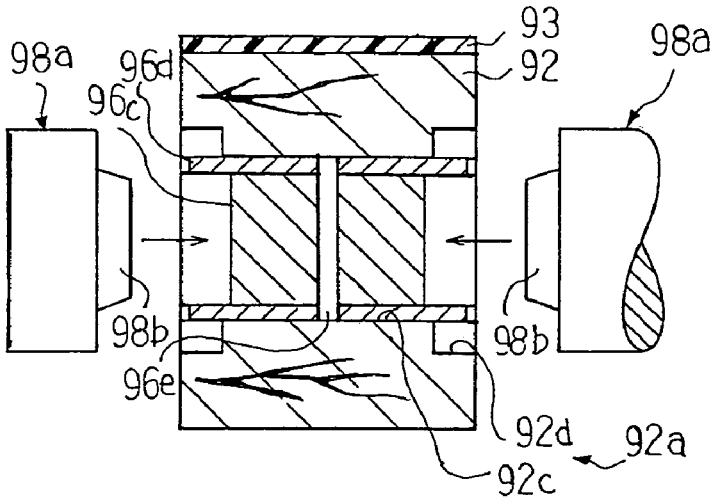
FIG. 20 is a cross sectional view showing caulking bits used for forming a fastener.

The fastener 96*b* is formed after the insertion of the tube/weight column 96*d*/96*c* into the through-hole 92*a* as follows. FIG. 20 shows the tube/weight column 96*d*/96*c* just inserted into the through-hole 92*a*. The tube 96*d* is straight, and the length of the tube 96*d* is approximately equal to the width of the wood bar 92. A pair of caulking bits 98*a* is prepared. The caulking bits 98*a* have respective tapered portions 98*b*, and the tapered portions 98*b* have the minimum diameter equal to the inner diameter of the tube 96*d*. A worker aligns the tapered portions 98*b* with the inner space of the tube 96*d*, and presses the caulking bits 98*a* against both ends of the tube 96*d*. The end portions are flared so that the weight piece 96*a* is caulked to the wood bar 92. Thus, the flared end portions 96*f*, i.e., the fastener serves as an anchor.

As will be understood from the foregoing description, the flared end portions 96*f* keep the weigh piece 96*a* stable in the wood bar 92. The weight pieces 96*a* are neither chattered in nor dropped out from the wood bar 92, and are easily assembled with the wood bar 92 through the caulking. The fastener is implemented by the flared end portions 96*f* of the tube 96*d* so that any part is not required for the fastening. As a result, the production cost is reduced.

The press fitting is not required for the key balancers 94. Any force is not exerted on the wood bar 92 in the direction of the thickness thereof, and, accordingly, the wood bar 92 is never cracked.

Figure 21:
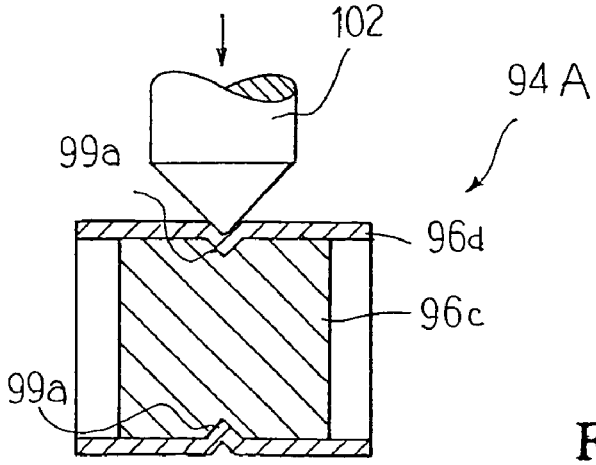
FIG. 21 is a cross sectional view showing the first modification of the key balancer.

The first modification 94A of the key balancer 94 is shown in FIG. 21. The tube 96*d* is fixed to the weight column 96*c* by means of projections 99*a* formed by using a punch 102. The pin 96*e* is not required for the weight piece of the key balancer 94A, and the production cost is further reduced. Both end portions of the tube 96*d* are flared after insertion into the through-hole 92*a*. The tube 96*d* and the weight column 96*c* may be monolithic.

Figure 22:
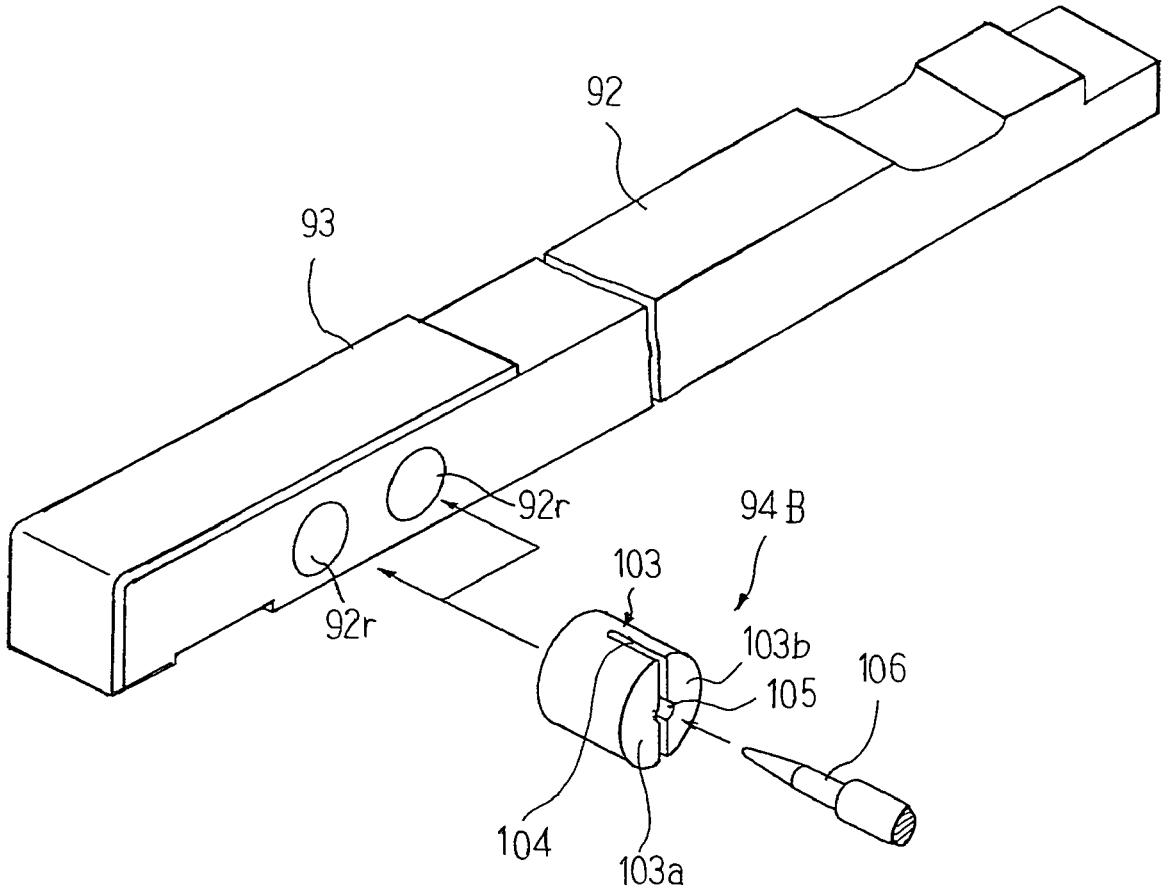
FIG. 22 is a perspective view showing the second modification of the key balancer.
Figure 2:
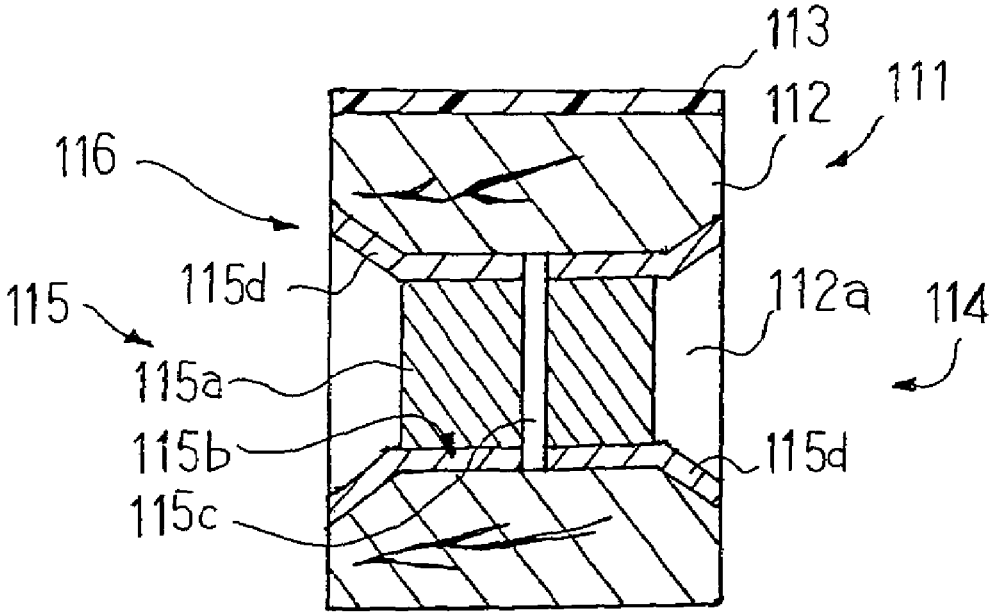
Figure 2:
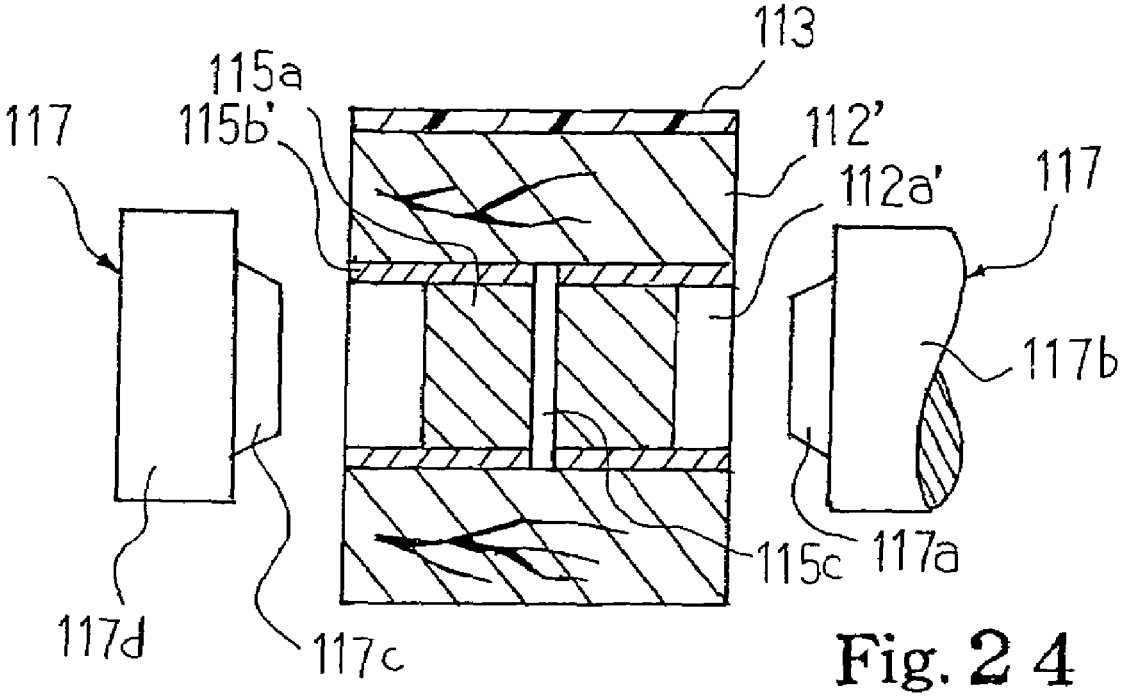

FIG. 22 shows the second modification 94B of the key balancer 94. Straight through-holes 92*r* are formed in the wood bar 92, and the key balancer 94B is implemented by a weight column 103. A slit 104 is formed in the weight column 103, and semi-column portions 103*a*/103*b* are opposed to each other through the slit 104. A pair of semi-conical recess 105 is formed in the semi-column portions 103*a*/103*b*, and is narrower than a punch 106. The weight columns 103 are firstly inserted into the through-holes 92*r*, respectively. A worker aligns the punch 106 with the pair of semi-conical recess 105, and inserts the tip of the punch 106 into the pair of semi-conical recess 105. The worker hits the punch 106 so that the tip deeply inserted into the pair of semi-conical recess 105. The semi-column portions 103*a*/103*b* are plastically deformed, and are spaced from each other. The outer surfaces of the semi-column portions 103*a*/103*b* are pressed to the inner surface defining the through-hole 92*r*, and the weight column 103 is fastened to the wood bar 92. In this instance, the semi-column portions 103*a*/103*b* serves as an anchor.

It is preferable to direct the slit 104 in the vertical direction as shown in FIG. 22, because the wooden bars 92 are not cracked. In other words, the expanded semi-column portions 103*a*/103*b* do not exert the force in the direction of the thickness of the wooden bars 92, and the wooden bars 92 withstand the expanded semi-column portions 103*a*/103*b*.

Turning to FIG. 23 of the drawings, a key 111 forming a part of a keyboard, which is incorporated in an acoustic piano. The acoustic piano is similar to that shown in FIG. 1 except the keys 111. For this reason, description is focused on the key 111, and, if necessary, the other component parts are specified by using references designating corresponding parts shown in FIG. 1.

The key 111 comprises a wood bar 112, a decorative plate 113 and key balancer or balancers 114. The wood bar 112 may be similar to the wood bar 92. The upper surface and front end surface of the wood bar 112 are covered with the decorative plate 113. The decorative plate 113 has a shape like an angle plate, and is adhered to the wood bar 112. The decorative plate 113 may be made of synthetic resin. In this instance, the synthetic resin is colored in white.

At least one through-hole 112*a* is formed in the front portion of the wood bar 112. In case where plural through-holes 112*a* are formed, plural balancers 114 are respectively required for each key, and are embedded into the plural through-holes 112*a*, respectively. The through-hole 112*a* is open at both ends thereof onto the side surfaces of the wood bar 112. The through-hole 12*a* is enlarged in diameter at both end portions thereof, and is constant in diameter between the end portions. The key balancer 114 is embedded in the through-hole 112*a* so as to exert the counter moment on the white key 111.

The key balancer 114 includes a weight piece 115 and a fastener 116. The weight piece 115 has a weight column piece 115*a*, a tube 115*b* and a pin 115*c*. In this instance, both of the weight column piece 115*a* and tube 115*b* are made of metal. At least the metal for the tube 115*b* is rich in plasticity, and is easily deformed. The tube 115*b* has an intermediate portion equal in diameter to the intermediate portion of the through-hole 112*a*, and is flared at both end portions 115*d*. The flared end portions 115*d* are tightly held in contact with the diverged end portions of the through-hole 112*a*, and prevent the weight piece 115 from dropping out from the through-hole 112*a*. Thus, the flared end portions 115*d* serve as the fastener 116. On the other hand, the outer diameter of the weight column piece 115*a* is equal to or slightly less than the inner diameter of the intermediate portion of the tube 115*b*, and the length of the weight column piece 115*a* is equal to the length of the intermediate portion of the tube 115*b*. A hole is formed in the tube 115*b* in the direction perpendicular to the axial direction of the tube 115*b*, and has an inner diameter equal to or slightly less than the outer diameter of the pin 15*c*. The pin 15*c* is driven into the hole so that the weight column piece 115*a* is secured to the tube 115*b*.

The tube, weight column piece and pin 115*a*/115*b*/115*c* are assembled into the weight piece 115 as follows. As shown in FIG. 24, the wood bar 112' has been formed with a straight through-hole 112*a*', and the decorative plate 113 has been already adhered to the wood bar 112'. The weight column piece 115*a* has been already secured to a straight tube 115*b*' by means of the pin 115*c*. However, both end portions have not been flared, yet. The straight through-hole 112*a*' is constant in diameter. This means that the straight through-hole 112*a*' has not been enlarged in diameter at both end portions thereof.

First, the straight tube 115*b*' is inserted into the straight through-hole 112*a*' together with the weight column 115*b*' and pin 115*c*. Subsequently, a pair of caulking tools 117 is prepared, and an assembling worker moves the caulking tools 117 to the waiting positions on both sides of the wood bar 112 as shown in FIG. 24. The caulking tool 117 on the right side has a frusto-conical head 117*a* and a stem 117*b*, and the other caulking tool 117 on the left side has a frusto-conical head 117*c* and a body 117*d*. The frusto-conical heads 117*a* and 117*c* are increased in diameter toward the stem 117*b* and body 117*d*. The minimum diameter of the frusto-conical heads 117*a* and 117*c* is less than the inner diameter of the straight tube 115*b*'. However, the maximum diameter is greater than the inner diameter.

Subsequently, the caulking tools 117 are pressed to the straight tube 115*b*'. The frusto-conical heads 117*a* and 117*c* are brought into contact with the straight tube 115*b*'. Then, the force exerted on the caulking tools 117 is increased. Then, both end portions 115*d* are flared as shown in FIG. 23, and the flared end portions 115*d* compress the side portions of the wood bar 112'. The wood bar 112' is partially crushed, and both end portions of the through-hole 112*a* are diverged. The flared end portions 115*d* are held in tight contact with the side portions of the wood bar 112 as shown in FIG. 23 so that the weight piece 115 does not chatter in the through-hole 112*a*. Even if thrust is sideward exerted on the weight piece 115, the flared end portions 115*d* do not allow the weight piece 115 to drop out from the wood bar 112. Thus, the weight piece 15 is secured to the wood bar 112.

Although the flared end portions 115*d* compress the side portions of the wood bar 112, the compressive force is exerted on the side portions, only, i.e., not on the entire inner surface of the through-hole 112*a*. The wood bar 112 is never separated into plural plies. Thus, the weight piece 115 does not destroy the wood bar 112.

Figure 25:
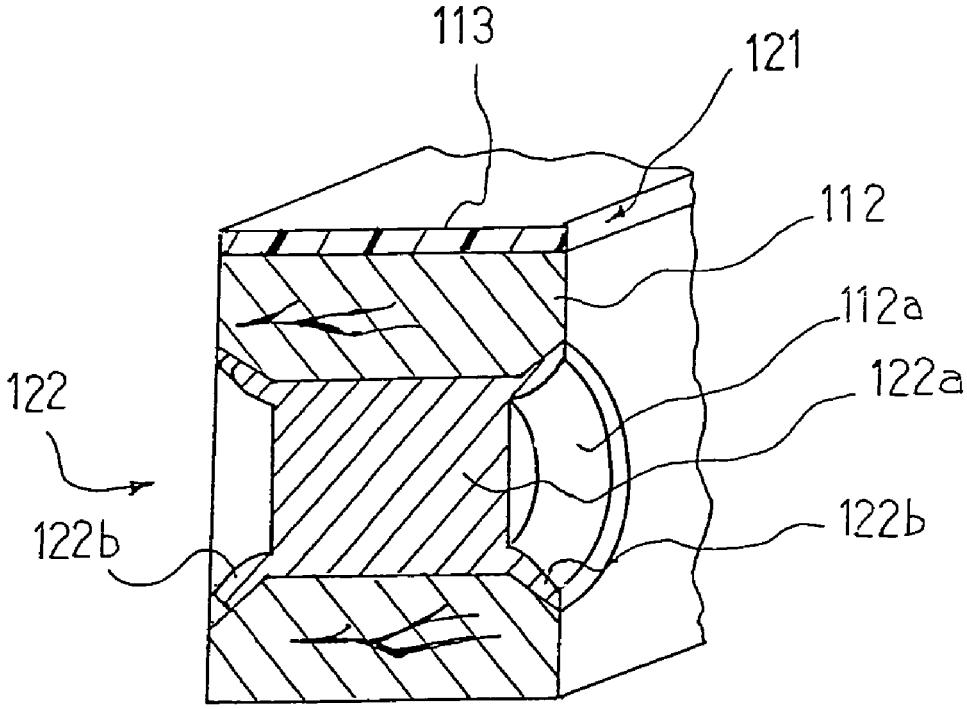
FIG. 25 is a cross sectional perspective view showing the structure of a modification of the key.

FIG. 25 shows a modification of the key 111, and is labeled with reference numeral 121. A wood bar and a decorative plate are similar to those of the key 111, and are respectively labeled with reference numerals 112 and 113 without detailed description. A major difference of the key 121 from the key 111 is directed to a weight piece 122. The weight piece 122 is monolithic, and has a rigid portion 122*a* and collar portions 122*b*. The collar portions 122*b* are cylindrical, and project from both ends of the rigid portion 122*a* in the opposite directions. The collar portions 122*b* are flared, and are held in tight contact with the diverged side portions of the through-hole 112*a*. Even if the weight piece 122 is sideward pressed, the flared collars 122*b* prevent the weight piece 122 from dropping out from the through-hole 112*a*.

A rigid metal column may be machined so as to be formed with the straight collars 122*b* on both sides of the rigid portion 122*a*. The rigid metal column is inserted into the straight through-hole 112*a*', and the collar portions 122*b* are flared by using the caulking tools 117 as similar to the weight piece 115. The weight piece 115 does not chatter, and is hardly dropped out from the wood bar 112. The wood bar 112 is hardly separated into plural plies, because the compressive force is exerted on only the side portions of the wood bar 112. Moreover, the weight piece 122 makes the assembling work speedy, because the weight piece 122 is monolithic.

Figure 26:
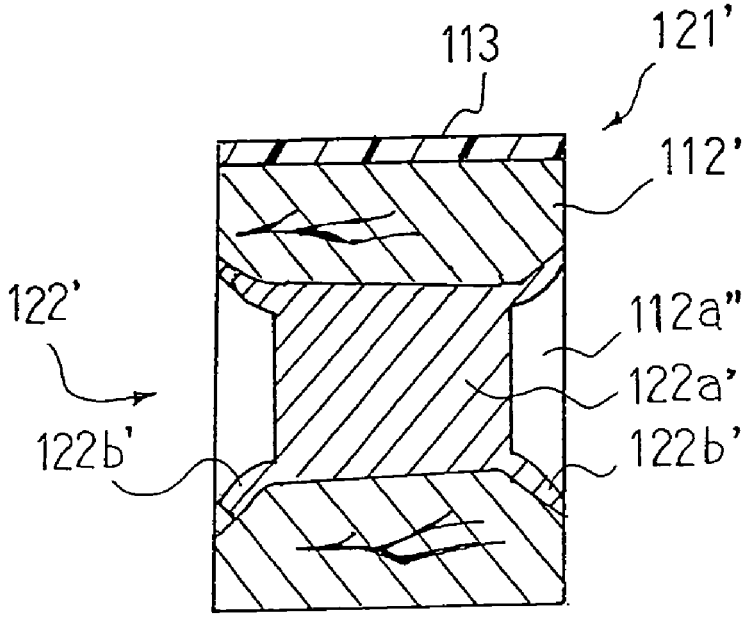
FIG. 26 is a cross sectional view showing the structure of another modification of the key.

FIG. 26 shows another modification 121' of the key 111. The key 121' includes a wood bar 112', a weight piece 122' and the decorative plate 113. A difference between the wood bar 112 and the wood bar 112' is a tapered through-hole 112*a*". Accordingly, the weight piece 122' is tapered as similar to the tapered through-hole 112*a*". The weight piece 122' has a rigid portion 122*a*' and collars 122*b*'. The rigid portion 122*a*' and collars 122*b*' are tapered. In the assembling work, a worker inserts the weight piece 122' into the tapered through-hole 112*a*" from the left side of the wood bar 112'. The weight piece 122' stops inside the tapered through-hole, and never passes through the tapered through-hole 112*a*". Thus, the tapered through-hole 112*a*" and tapered weight piece 122' make the assembling work easy.

In the first to third embodiments and their modifications, the action units 7, hammers 11 and the strings form parts of a tone generating system.

In the first to third embodiments and their modifications, the key balancers are embedded in the front portions of the wooden bars. However, the key balancers may be embedded in the rear portions of the wooden bars in order to vary the moment of inertia. In many models of upright pianos, the key-touch is dominated by the moment of inertia, and the key balancers are embedded in the rear portions of the wooded bars.

From the viewpoint of the key-touch, the term "moment" means both of the moment of force and the moment of inertia, and term "regulative moment" means the counter-moment and the factor for varying the moment of inertia.

The above-described changes may be applied to the key 111/112. Moreover, the through-hole 112*a*' and end portions of said tube member 115*b*' may be lightly tapered. The straight through-holes, tapered through-hole, straight end portions 115*b*', tapered end portions, straight collars and tapered collars are referred to as "substantially straight through-holes", "substantially straight end portions" and "substantially straight collars" in claims.

Although particular embodiments of the present invention have been shown and described, it will be apparent to those skilled in the art that various changes and modifications may be made without departing from the spirit and scope of the present invention.

In case where the manufacturer does not make the side surfaces of the black/white keys flat, straight through-holes are formed in the wooded bars. In other words, the wide portions such as, for example, 92*d* are not required, and the machining cost is reduced.

The keys 21, 51 and 91 are available for en electronic keyboard and a composite keyboard musical instrument. In the electronic keyboard, the wood bars 22, 52, 92 may be replaced with bars made of synthetic resin, and are swingably connected to a frame by means of pins. In the electronic keyboard, a key scanner, an information processing system, a tone generator and a sound system form in combination the tone generating system. The keys are periodically scanned by the key scanner to see whether or not a player depresses any one of the keys. The key scanner is connected to the key sensors for monitoring the keys, and supplies a key scanning signal representative of a key or keys depressed or released by a player. The key scanner is connected to the information processing system, and the information processing system analyzes the key scanning signal for specifying the key or keys. The information processing system produces music data codes representative of the tone or tones to be generated or decayed, and supplies the music data codes to the tone generator. The tone generator produces a digital tone signal on the basis of the music data codes, and converts the digital tone signal to an analog tone signal. The analog tone signal is supplied to the sound system, and electronic tones are produced from the analog tone signal.

What is claimed is:

1. A keyboard musical instrument for generating tones, comprising:

a keyboard including plural keys used for specifying pitches of tones to be produced, applied with moments urging said plural keys to rest positions thereof and having respective bars each formed with at least one through-hole, said at least one through-hole having a narrow portion and wide portions diverging from both ends of said narrow portion and exposed to side surfaces of said bar, each of said plural keys having at least one key balancer for applying a regulative moment to said each of said plural keys for varying the moment, said at least one key balancer having a weight piece made of non-lead material and embedded in the bar of said each of said plural keys and an anchor for fixing said weight piece to said bar of said each of said plural keys, said weight piece having a tube member received in said at least one through-hole and a core member received in said tube member, both end portions of said tube member being plastically deformed so as to be held in tight contact with said wide portions of said bar as said anchor; and a tone generating system connected to said plural keys, and generating said tones with said pitches.

2. The keyboard musical instrument as set forth in claim 1, in which said weight piece further has a pin passing through said tube member and said core member so that said core member is secured to said tube member.

3. The keyboard musical instrument as set forth in claim 1, in which said weight piece has a rigid core portion and collar portions integral with said rigid core portion and projecting from both ends of said rigid core portion in opposites directions, respectively.

* * * * *